US011284715B2

(12) United States Patent
Goldhammer et al.

(10) Patent No.: US 11,284,715 B2
(45) Date of Patent: Mar. 29, 2022

(54) PORTABLE, CONVERTIBLE, AND MODULAR LAP DESK

(71) Applicant: Aeon Gold, LLC, San Antonio, TX (US)

(72) Inventors: Troy M. Goldhammer, San Antonio, TX (US); Daniel F. Caputo, Cedar Park, TX (US); Benjamin Derek Litteral, Austin, TX (US); Roy Paul Prosise, Cedar Park, TX (US); Jeffrey J. Schorr, San Antonio, TX (US); Michael W. Wade, San Antonio, TX (US)

(73) Assignee: Aeon Gold, LLC, San Antonio, TX (US)

( * ) Notice: Subject to any disclaimer, the term of this patent is extended or adjusted under 35 U.S.C. 154(b) by 0 days.

(21) Appl. No.: 16/662,347

(22) Filed: Oct. 24, 2019

(65) Prior Publication Data

US 2020/0128953 A1 Apr. 30, 2020

Related U.S. Application Data

(60) Provisional application No. 62/750,973, filed on Oct. 26, 2018.

(51) Int. Cl.
*A47B 23/00* (2006.01)
*A47B 23/06* (2006.01)

(52) U.S. Cl.
CPC ..... *A47B 23/002* (2013.01); *A47B 23/06* (2013.01); *A47B 2200/0027* (2013.01)

(58) Field of Classification Search
CPC ..... F16M 13/04; F16M 13/00; F16M 13/10; F16M 13/088; F16M 13/08; F16M 11/24; F16M 11/10; A47F 5/00; A47F 2200/0525; A47F 2200/005; A47F 2200/0834; A47F 2200/0003; A47F 3/10; A47F 3/08; A47F 3/0818; A47F 2003/146; A47B 23/002; A47B 23/001; A47B 2023/005
USPC ..... 224/265, 270, 257, 256, 325, 930, 625; 108/43, 50.01, 50.02, 90, 147, 116, 125, 108/129, 131, 132, 25, 26, 1, 9, 12, 18
See application file for complete search history.

(56) References Cited

U.S. PATENT DOCUMENTS 732,585 A * 6/1903 Reinhart
2,905,513 A * 9/1959 Kane ..... A47B 3/00 108/128

(Continued)

FOREIGN PATENT DOCUMENTS

CN 1111887589 * 11/2020
DE 3408886 * 9/1985

(Continued)

*Primary Examiner* — Janet M Wilkens
(74) *Attorney, Agent, or Firm* — Lee & Hayes, P.C.

(57) ABSTRACT

A portable, convertible, and modular lap desk for use with various types of electronic devices. In some cases, the lap desk may be configured with extendible legs to provide a plurality of adjustable height positions. For instance, the legs may include a closed position, a partially extended position, and a fully extended position for use in different situations. The lap desk may also include on board power supplies, various compartments for storing the electronic devices and on boarding cabling and cable routing to more efficiently organize and couple multiple devices.

18 Claims, 20 Drawing Sheets

(56) References Cited

U.S. PATENT DOCUMENTS

| | | | | | |
|---|---|---|---|---|---|
| 4,312,507 | A * | 1/1982 | Smith | A47B 23/001 108/23 |
| 5,127,647 | A * | 7/1992 | Wilkinson | A63B 23/0458 108/12 |
| 5,915,659 | A * | 6/1999 | Scannell, Jr. | A47B 9/08 108/10 |
| D434,234 | S * | 11/2000 | Ferrentino | D6/336 |
| 6,823,802 | B2 * | 11/2004 | Butts, Jr. | A47B 3/0912 108/144.11 |
| 8,421,407 | B2 * | 4/2013 | Johnson | H02J 7/0044 320/108 |
| 9,635,933 | B2 * | 5/2017 | Rosing | A47B 23/046 |
| 10,202,081 | B2 * | 2/2019 | Krishnan | B60R 5/045 |
| 2007/0056482 | A1 * | 3/2007 | Robinson | A47B 37/04 108/25 |
| 2008/0115698 | A1 * | 5/2008 | Beam | A47B 37/00 108/50.02 |
| 2009/0078165 | A1 * | 3/2009 | Tseng | A47B 3/0912 108/6 |
| 2014/0117004 | A1 * | 5/2014 | Sambonet | A47B 13/16 219/218 |
| 2019/0331406 | A1 * | 10/2019 | Jeong | F25D 25/02 |
| 2019/0344312 | A1 * | 11/2019 | Palmer | A47B 13/088 |
| 2020/0015453 | A1 * | 1/2020 | Escalante | A47B 9/14 |

FOREIGN PATENT DOCUMENTS

| | | | |
|---|---|---|---|
| DE | 3831597 | * | 3/1990 |
| WO | WO2017156589 | * | 9/2017 |
| WO | WO2018186231 | * | 10/2018 |
| WO | 2020035963 | * | 2/2020 |

* cited by examiner

PORTABLE, CONVERTIBLE, AND MODULAR LAP DESK

CROSS-REFERENCE TO RELATED APPLICATION(S)

This application claims priority to U.S. Provisional Application No. 62/750,973 filed on Oct. 26, 2018 and entitled "Portable, Convertible, and Modular Lap Desk," which is incorporated herein by reference in its entirety.

BACKGROUND

Portable electronic devices are becoming more and more prevalent in societies around the world. While the larger portable electronic devices are portable from location to location, they often still require a flat surface, such as a table, and nearby power sources for any type of extended usage. Thus, while the electronic devices themselves are portable, often times the user is still tied to particular types of locations such as a desk near a wall outlet.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

DETAILED DESCRIPTION

Figure 1A:
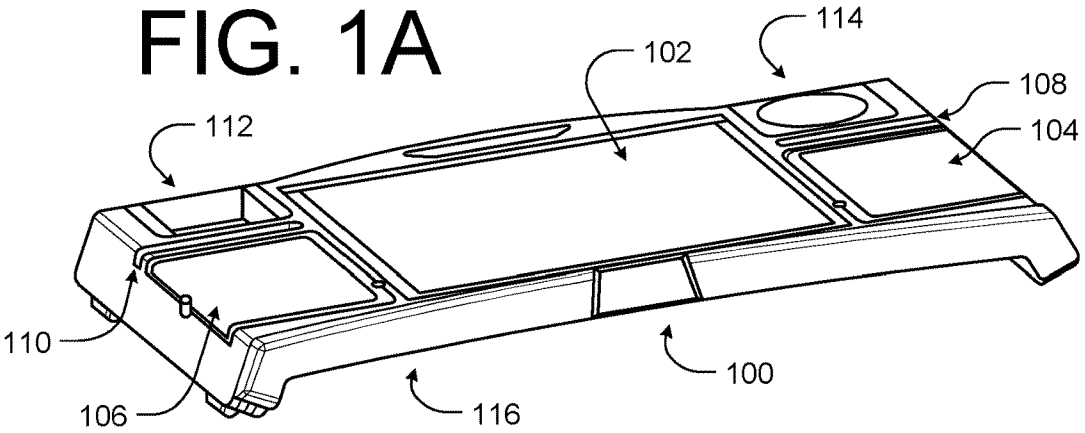
FIGS. 1A and 1B illustrates example perspective views of a lap desk in a closed position according to some implementations.

This disclosure includes an apparatus for a portable, convertible, and modular lap desk. In some cases, the lap desk may be configured with extendible legs to provide a plurality of adjustable height positions. For instance, the legs may include a closed position, a partially extended position, and a fully extended position for use in different situations. For example, the closed position may be used when the user intends to rest the desk on their lap, the partially extended position may be used when the user is sitting in bed and desires to support the desk on the bed rather than on the user's lap. In this example, the bed may provide for a more stable surface such as when the user is drawing, writing, or using a stylus. The user may also use the fully extended position when the lap desk is placed upon a lower table, such as a coffee table, and the user is working from the living room sofa.

In the closed position, the lap desk may be configured to include a netting or fabric portion positioned under the bottom surface of the lap desk. The netting allows the desk to sit upon the lap of the user in a more comfortable configuration. For example, the netting may take the weight of the desk along the length of the user's lap spreading the pressure points and allowing some give. The reduction in pressure points allows the user to rest the desk upon their lap for longer period than a conventional lap desk. In some implementations, the netting may be retractable. For example, the netting may be located on the left-hand side of the desk and pulled by the user over the length of the bottom surface of the desk and releasably coupled to the right-hand side of the desk when in use. The user may then uncouple the netting form the right-hand side and retract the netting into the left-hand side of the table. Thus, unlike conventional lap desks, the netting may be stowed when not in use to allow additional leg room for the user when the desk is in the partially extended position or the fully extended position. In addition to adding leg room for the user when not in use, the retractable netting may allow for a narrower less bulky design of the desk and may allow for shorter legs, compared to conventional lap desks.

In some implementations, the lap desk may also be modular. For example, the lap desk may include interchangeable components that may electrically and/or communicatively couple to the desk along the exterior surface. The interchangeable components may include back-up battery or power supplies, speakers, lights (such as a desk lamp), stylus pad, mouse, joystick, keyboard, display components, touch enabled components, other types of user interfaces, communication interfaces (e.g., sim card interfaces, universal serial bus (USB) interfaces, DVD or CD readers, etc.), among others. The interchangeable components may also include low or no power components, such as a cup holder, pen/pencil holders, pencil sharpeners, desk extenders, different top surfaces (e.g., stick surface, non-stick surface, leather, wood, metallic, plastic or polymer, patterned, colored, etc.), upright cell phone holder/stand, upright tablet holder/stand, among others. In some cases, the desk may also be configured to electrically and/or communicatively couple to the user's portable electronic device, such that the portable electronic device may access, control, or receive input signals from the interchangeable components.

By allowing for interchangeable components the lap desk may be customized for the user's needs on a situation by situation basis. For example, if the user is at a location away from a power source (such as a coffee shop), the user may couple a battery life extender or back-up battery to the desk and the user may utilize the back-up battery to power the user's portable electronic devices. In another example, if the user is at a location that has poor lighting, the user may couple a lamp or other light source to illuminate the surface of the lap desk as well as any material or electronic devise placed thereon.

In some case, the lap desk may be approximately 25.6 inches wide, approximately 16.0 inches long, and between approximately 1.2 and 2.9 inches thick including the folded legs. In some instances, the desk portion excluding the folded legs may be between approximately 1.2 and 1.5 inches thick. In various implementations, the lap desk may be between approximately 20.0 and 30.0 inches wide, approximately 10.0 and 20.0 inches high, and approximately 0.5 to 2 inches thick. In some specific example, in the closed position the height from the top surface of the lap desk to the bottom of the legs may be approximately 2.6 inches or between approximately 2.0 and 3.0 inches. In the partially extended position the height from the top surface of the lap desk to the bottom of the legs may be approximately 7.4 inches or between approximately 6.0 and 9.0 inches. In the fully extended position the height from the top surface of the lap desk to the bottom of the legs may be approximately 11.3 inches or between approximately 9.0 and 13.0 inches.

Figure 1B:
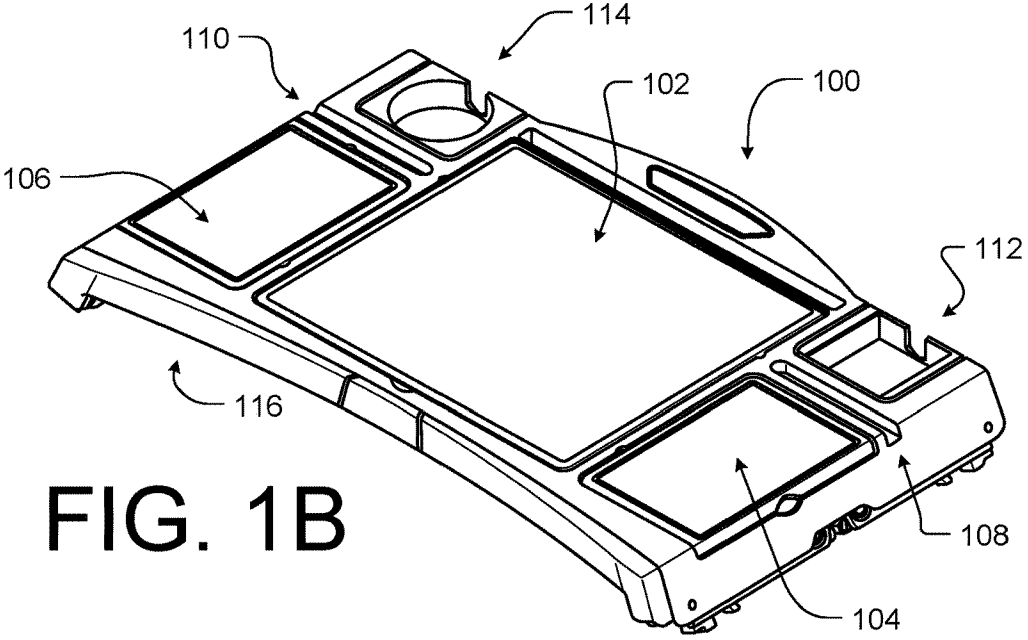

FIGS. 1A and 1B illustrates an example lap desk 100 in a closed position according to some implementations. In the current example, the lap desk 100 has the legs (not shown) retracted, such that the desk 100 may be placed on the lap of a user. As will be described in more detail below, the lap desk 100 in the closed position may be equipped with a netting to assist with balancing the desk 100 on the lap of the user as well as to provide a more comfortable user experience and allowing for longer periods of use, as discomfort is reduced with respect to conventional lap desks.

The lap desk 100 may include a desk surface 102 as well as two side pad surfaces, such as right pad surface 104 and left pad surface 106. In some cases, the desk surface 102 may be configured for writing, such as pen and paper, or for use with an electronic device, such as a notebook computer or tablet. The right and left pad surfaces 104 and 106 may be configured for use with an input device, such as a mouse or joystick. In some specific examples, the right and left pad surfaces 104 and 106 may be touch enabled pads that may be used with, for instance, a stylus to provide input signals to the notebook computer or tablet on the desk surface 102.

In some implementations, the right pad surface 104 and/or the left pad surface 106 may be removeable or interchangeable. For example, a stylus pad may be coupled to the lap desk 100 at the location of the right pad surface 104 and a mouse pad may be coupled to the lap desk 100 at the location of the left pad surface 106. In some cases, the right and left pad surface 104 and 106 may be interchangeable with various surfaces, such as wood, polymer or plastics, leather, felt, silicone, etc. The right and left pad surface 104 and 106 may include interchange components, such as a mouse pad, joystick, keyboard, touch input device, displays, touch enabled displays, speakers, memory devices, electronic communication interfaces, portable power sources (e.g., back-up batteries), etc. Similarly, the desk surface 102 may also be interchangeable. For instance, the desk surface 102 may be interchanged to include components, such as various surfaces (e.g., wood, polymer or plastics, leather, felt, silicone), displays, touch enabled displays, keyboards, various docking stations connections, power sources, memory devices, game board surfaces (e.g., chess or backgammon boards), etc.

In the current example, the lap desk 100 also includes a stylus or pen slots 108 and 110. The pen slots 108 and 110 may be used to store the stylus or pen when not in use. The illustrated lap desk 100 also includes a tray 112 and a cup holder 114. In some implementations, the try 112 and cup holder 114 may be interchangeable with other components. For example, the try 112 and/or cup holder 114 may be replaced with additional trays or cup holders having various shapes and sizes, displays, speakers, memory devices, electronic communication interfaces, portable power sources (e.g., back-up batteries), light sources (e.g., lamps), photo frames, etc.

In some cases, the desk surface 102 is also interchangeable. For example, the desk surface 102 may be formed from different materials such as wood, plastic, rubbers, or other polymers. In some cases, the desk surface 102 may be configured to include a desired graphic or company logo, lighted or unlighted, or even used as a display component. For instance, the desk surface 102 may form a display while the right or left right and left pad surface 104 and 106 may be a touch input device, such as keypad or touch enabled display. In one example, the desk surface 102 may be configured as a heat sink, venting, fans, or other include a cooling elements to reduce the temperature of the electronic device placed on the desk 100.

In some implementations, the lap desk 100 may also include a front bumper 116 to provide additional comfort to the user. For example, the front bumper 116 may be curved to prevent the development of a pressure point on the user's when the lap desk 100 is in the closed position. In some cases, the bumper 116 may be padded and/or formed from various materials, such as various polymers, various plastics, rubbers, cloth materials, etc.

Figure 2:
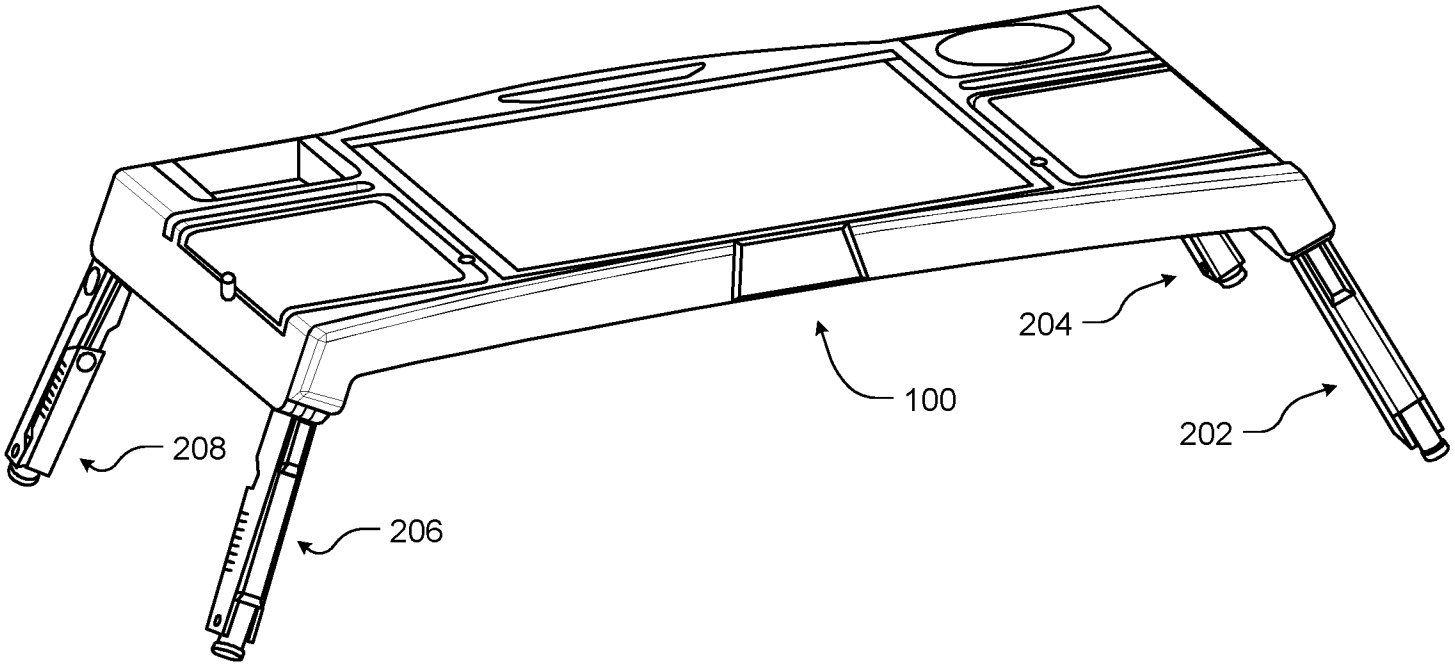
FIG. 2 illustrates an example perspective view of the lap desk in a partially extended position according to some implementations.

FIG. 2 illustrates an example the lap desk 100 in a partially extended position according to some implementations. In the current example, the legs 202-208 are shown as partially extended or in a second configuration. For instance, the legs 202-208 may fold or pull out from the closed position, shown in FIGS. 1A and 1B above, to the current partially extended position. In this position, the lap desk 100 may be placed over the user's lap and rest on, for instance, a sofa cushion to place the lap desk 100 at an appropriate height for use by a human. In some cases, the height of the lap desk 100 in the partially extended position may be fixed while in other example, the height may be adjustable between a range by the user (such as between 4.0 and 10.0 inches).

Figure 3:
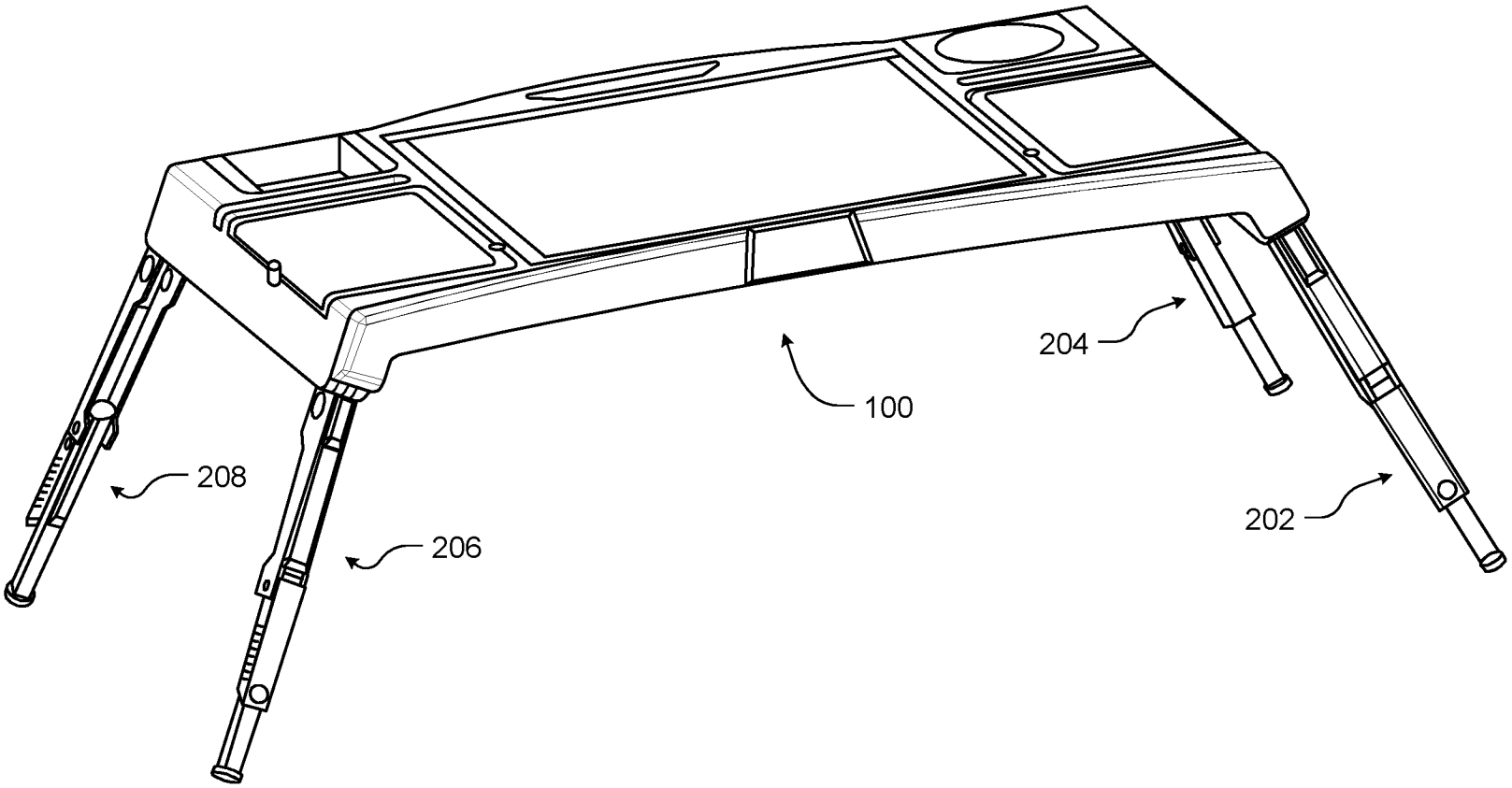
FIG. 3 illustrates an example perspective view of the lap desk in a fully extended position according to some implementations.

FIG. 3 illustrates an example the lap desk 100 in a fully extended position according to some implementations. In the current example, the legs 202-208 are shown as fully extended or in a third configuration. For instance, the legs 202-208 may fold or pull out from the closed position, shown in FIGS. 1A and 1B above, and then slide or further fold out from the partially extended position, shown in FIG. 2, to the current fully extended position. In this position, the lap desk 100 may be placed on a low desk, coffee table, counter top, etc. to place the lap desk 100 at an appropriate height for use by a human. In some cases, the height of the lap desk 100 in the partially extended position may be fixed while in other example, the height may be adjustable between a range by the user (such as between 9.0 and 14.0 inches). For instance, the legs 202-208 may each include two parts a top portion and a bottom portion. The bottom portion may be stored inside of the top portion and be extended by pulling downward. In some cases, the bottom portion may include a plurality of locking position, each of which may cause the bottom portion to lock or mate with the top portion at a different height.

Figure 4:
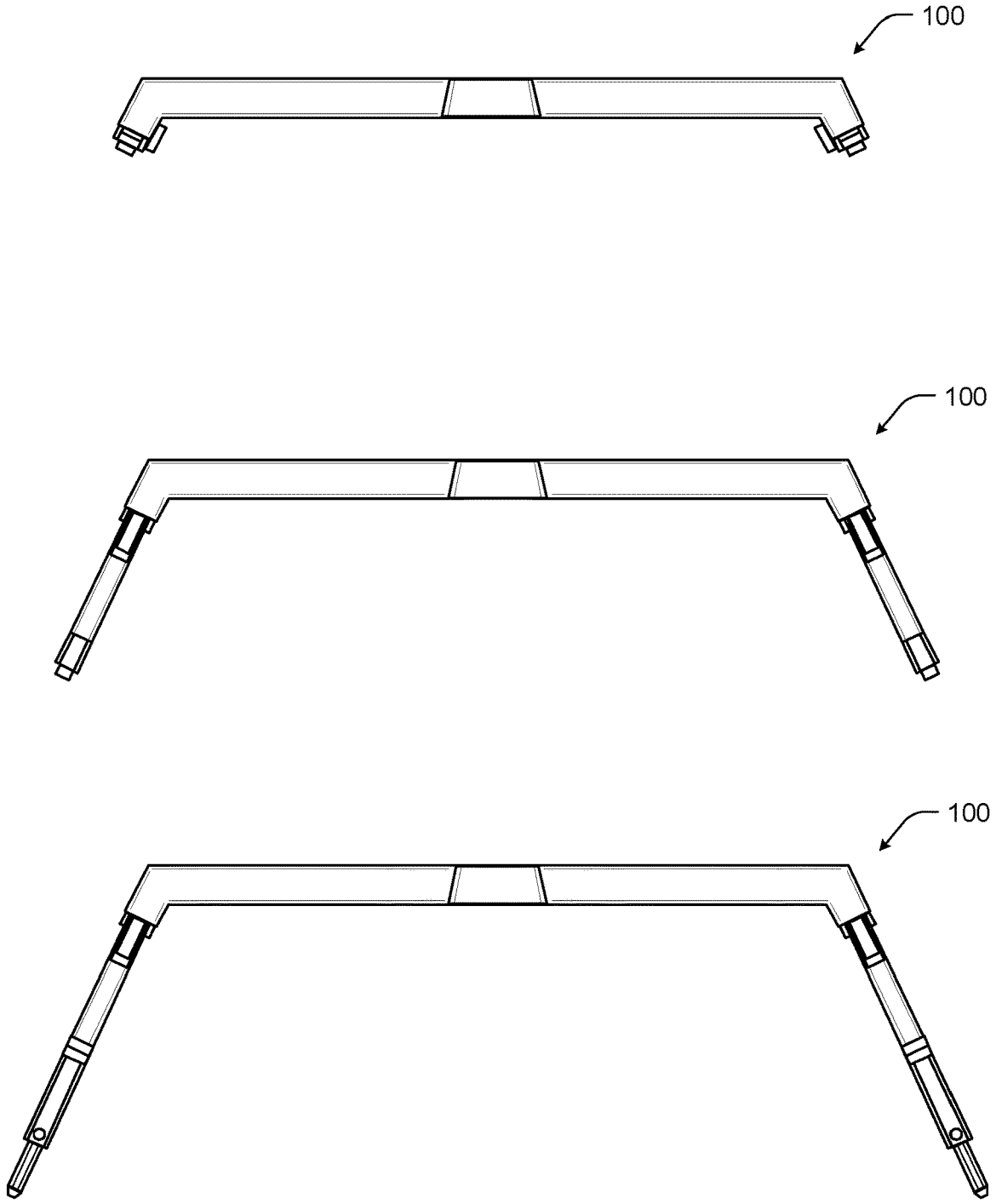
FIG. 4 illustrates an example front view of the lap desk in the closed position, partially extended position, and the fully extended position according to some implementations.

FIG. 4 illustrates the example the lap desk 100 in the closed position, partially extended position, and the fully extended position according to some implementations. As discussed above, the lap desk 100 may be approximately 25.6 inches wide, approximately 16.0 inches long, and approximately 1.4 inches thick. In various implementations, the lap desk 100 may be between approximately 20.0 and 30.0 inches wide, approximately 10.0 and 20.0 inches high, and approximately 0.5 to 2 inches thick. In some specific example, in the closed position the height from the top surface of the lap desk 100 to the bottom of the legs may be approximately 2.6 inches or between approximately 1.0 and 6.0 inches. In the partially extended position the height from the top surface of the lap desk to the bottom of the legs may be approximately 7.4 inches or between approximately 4.0 and 11.0 inches. In the fully extended position the height from the top surface of the lap desk to the bottom of the legs may be approximately 11.3 inches or between approximately 9.0 and 15.0 inches.

Figure 5:
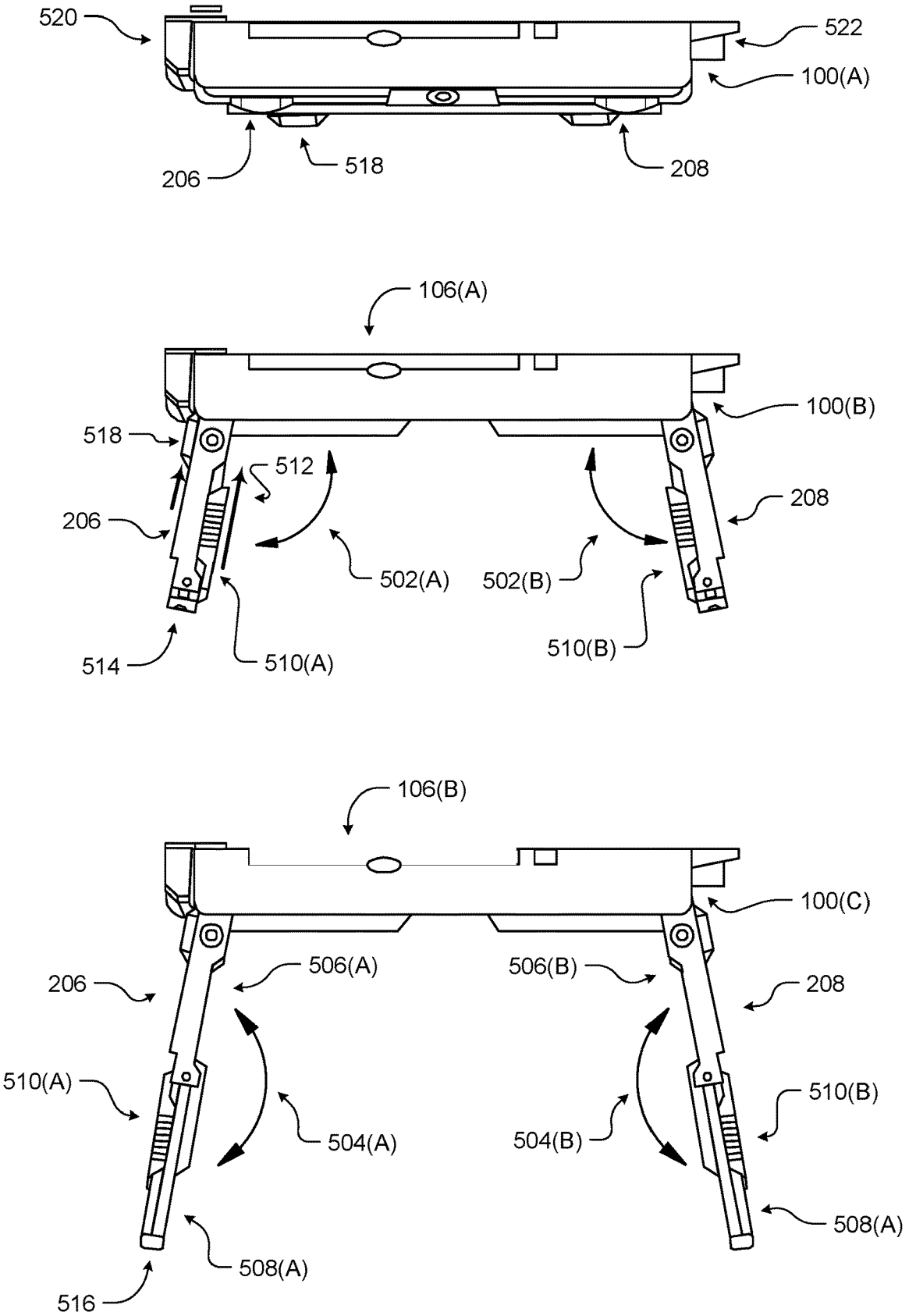
FIG. 5 illustrates an example side view of the lap desk in the closed position, partially extended position, and the fully extended position according to some implementations.

FIG. 5 illustrates an example side view of the lap desk 100 in the closed position, partially extended position, and the fully extended position according to some implementations. In the current example, the legs 206 and 208 may be extended by rotating outwards from the closed position 100(A) to the partially extended position 100(B) as shown by arrows 502(A) and 502(B). In some cases, a spring loaded foot 518 slides into a slot (not shown) within the inner structure (not shown) of the leg 206 to overcome the load on the spring. For example. The foot 518 may begin to slide when the leg 206 is rotated out somewhere from 70°-90°.

The legs 206 and 208 may then be further extended by rotating an inner portion 508 of the legs 206 and 208 outwards from an outer portion 506 of the legs 206 and 208 as shown by arrows 504(A) and 504(B). In some examples, the legs 206 and 208 may include a slide release mechanism, generally indicated by 510. For instance, one the legs are in the partially extended position, the user may slide the slide release mechanism 510 upwards as indicated by arrow 512 to release pressure caused by a spring within the inner portion 508 of the leg 206, to cause the inner portion 508 of the leg to release from the outer portion 506. The inner portion 508 may then be extended or rotated by 180° as shown by arrow 504. Once fully extended, as shown by desk 100(C), the desk 100(C) is in the fully extended position. In some cases, the legs 206 and 208 may lock in each of the closed position, partially extended position, and fully extended position.

In the illustrated example, the inner portion 508 of each of the legs 206 and 208 includes a first foot 514 on a first end of the inner portion 508 for use when the table 100 is in the partially extended position 100(B) and a second foot 516 on a second end of the inner portion 508 opposite the first end. The second foot 516 may be used when the table 100 is in the fully extended position 100(C). In general, the spring loaded foot 518, the first foot 514, and the second foot 516 may be formed from rubber, various polymers, or plastic.

In the current example, the legs 206 and 208 are shown as running from the front 520 (e.g., the user facing portion of the desk) of the desk 100 to the back of the desk 522. However, it should be understood that the legs 206 and 208 may be arranged from side to side. Additionally, the discussion above, provides one arrange from the legs 206 and 208 to deploy from the closed position 100(A) to the fully extended position 100(C), however, one skilled in the art would understand that other arrangements may be used.

In the current example, the desk 100(A) and 100(B) illustrates the left side surface 106(A) as coupled to the desk 102, while the desk 100(C) shows the left side surface as removed and in its place an opening 106(B) that may be used to couple other components as discussed above. For instance, a user may electrically and/or mechanically couple components, such as a mouse pad, joystick, keyboard, touch input device, displays, touch enabled displays, speakers, memory devices, electronic communication interfaces, portable power sources (e.g., back-up batteries), etc. to the desk 100 at the location 106(B).

Figure 6:
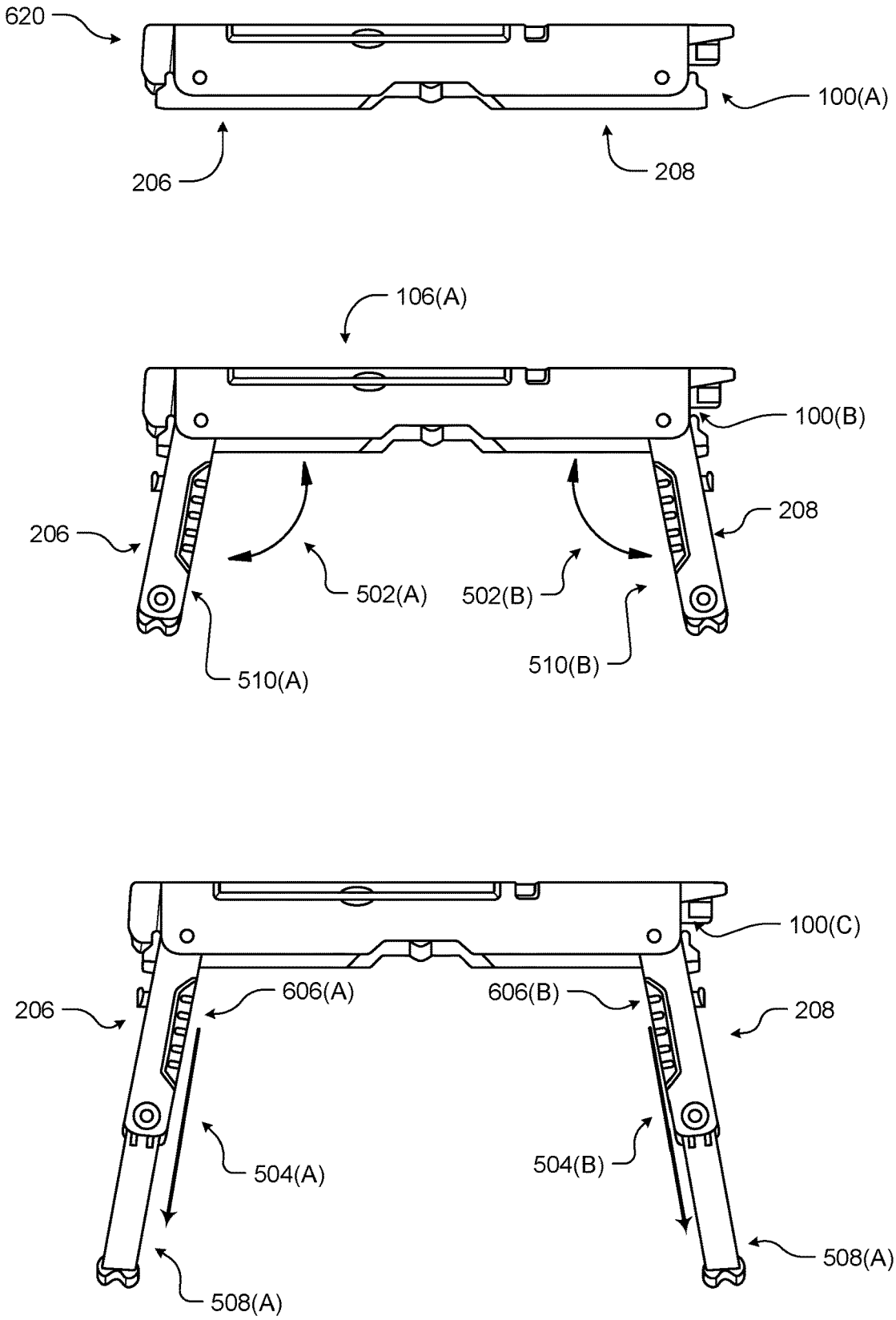
FIG. 6 illustrates another example side view of the lap desk in the closed position, partially extended position, and the fully extended position according to some implementations.

FIG. 6 illustrates another example side view of the lap desk 100 in the closed position, partially extended position, and the fully extended position according to some implementations. Again, the legs 206 and 208 may be extended from the closed position 100(A) to the partially extended position 100(B) as shown by arrows 502(A) and 502(B). The legs 206 and 208 may then be further extended by sliding an inner portion 508 of the legs 206 and 208 downward from the legs 206 and 208 as shown by arrows 504(A) and 504(B). In some examples, the legs 206 and 208 may include a slide release mechanism, generally indicated by 510. Once extended, as shown by desk 100(C), the desk 100(C) is in the fully extended position. In some cases, the legs 206 and 208 may lock in each of the closed position, partially extended position, and fully extended position.

Figure 7:
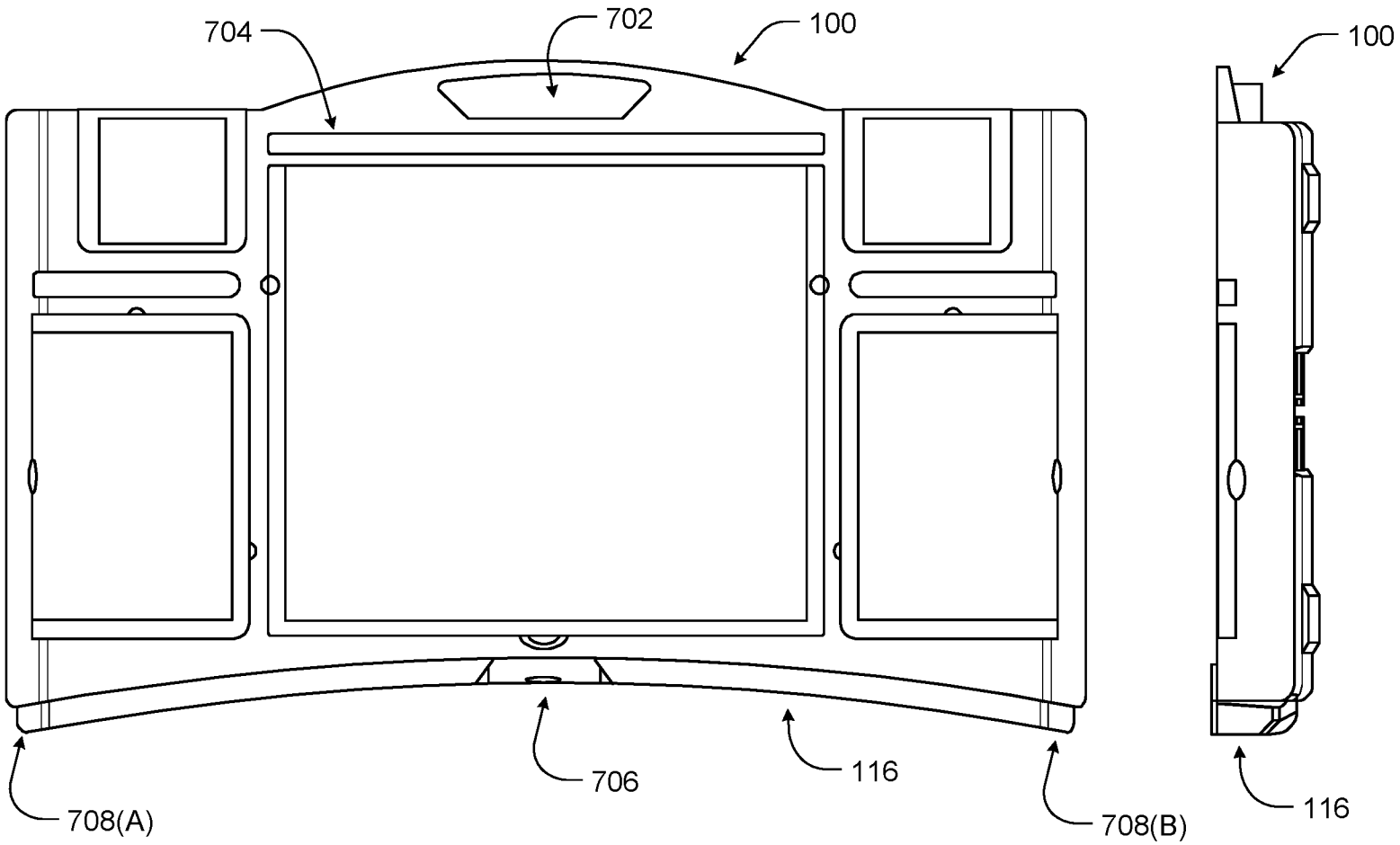
FIG. 7 illustrates an example top and side view of the lap desk according to some implementations.

FIG. 7 illustrates an example top and side view of the lap desk 100 according to some implementations. In the current example, the lap desk 100 may include a handle, generally indicated by 702, to provide an easy of transporting the desk 100 from location to location. In some case, the desk 100 may have a weight between approximately 0.5 pounds and 10 pounds. In one specific example, the desk 100 may be less than 2 pounds.

The desk 100 may also include a slot 704 for holding papers in an upright position. In some cases, the slot 704 may include an extendable member that allows the paper, book, tablet, or other items to rest in a substantially upright position for viewing by a user of the lap desk 100. In some cases, the extendable member may pull up from within the slot 704 to ensure a compact desk 100 when the desk 100 is in transit.

As discussed above, in some implementations, the lap desk 100 includes a front bumper 116. As currently illustrated, the bumper 116 that is curved with from a midpoint, generally indicated by 706, outward towards both ends, generally indicated by 708(A) and 708(B). The curve allows for a comfortable fit when placed against or in proximity to a torso of a user.

Figure 8:
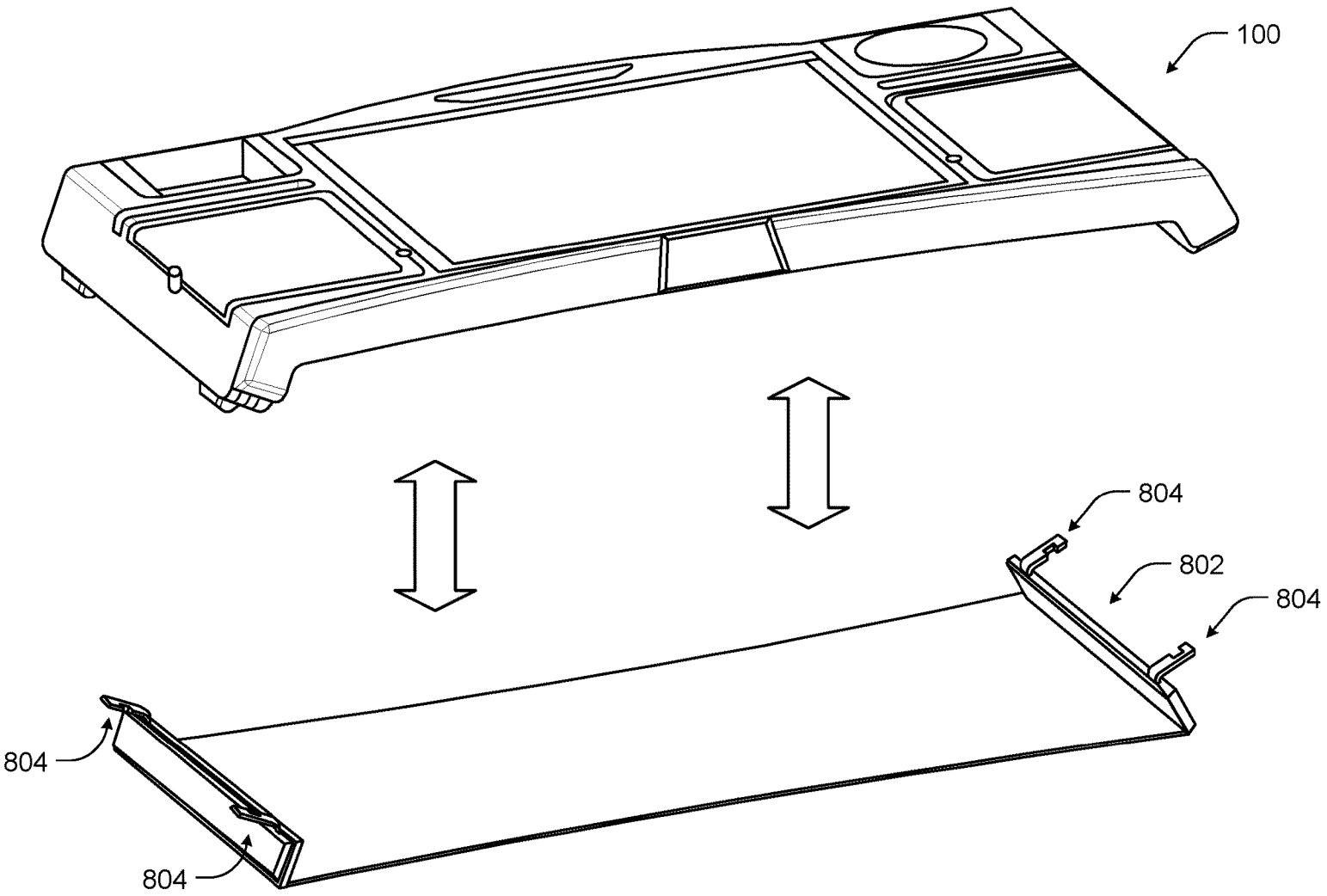
FIG. 8 illustrates an example perspective view of the lap desk in the closed position with netting removed according to some implementations.

FIG. 8 illustrates an example perspective view of the lap desk 100 in the closed position with netting 802 removed according to some implementations. For instance, as discussed above the lap desk 100 may include a closed position in which a user may place the lap desk 100 on their lap. In this position, the user may also attach or couple, the netting 802 to the lap desk 100. The netting 802 may allow the desk 100 to sit upon the lap of the user in a more comfortable configuration. For example, the netting 802 may take the weight of the desk 100 along the length of the user's lap/legs spreading the pressure points and allowing some give. The reduction in pressure points allows the user to rest the desk 100 upon their lap for longer period than a conventional lap desk. In the illustrated implementation, the netting 802 is removable or configured to releasably couple to the desk 100, such that the netting 802 may be removed when not in use. For instance, decoupling of the netting 802 may allow for additional leg room when the desk 100 is in the partially extended position or the fully extended position. In addition to adding leg room for the user when not in use, the netting 802 may allow for a narrower less bulky design of the desk 100 and may allow for shorter legs, compared to conventional lap desks.

In some cases, the netting 802 may be formed from various materials including nylon, polyester, spandex, various yarns (such as cotton yarn), other synthetic or plastic materials, or other natural materials. The netting 802 may be knotless or knotted. In some instances, the netting 802 may be a solid piece of fabric while in other cases the netting 802 may include gaps of uniform or nonuniform sizes.

In this implementation, the netting 802 may include various types of clips or attachment means, such as the clips 804. In this implementation, the netting 802 may be moved into position under the desk 100 and the clips 804 may be connected to mated clips (not shown) on the bottom of the desk 100.

In other implementations, the netting 802 may be retractable into the desk 100. For example, the netting 802 may be located on the left-hand side of the desk 100 and pulled by the user over the length of the bottom surface of the desk 100 and releasably coupled to the right-hand side of the desk 100 when in use. The user may then uncouple the netting form the right-hand side and retract the netting into the left-hand side of the table. Thus, unlike conventional lap desks, the netting 802 may be stowed within the desk 100 when not in use.

Figure 9:
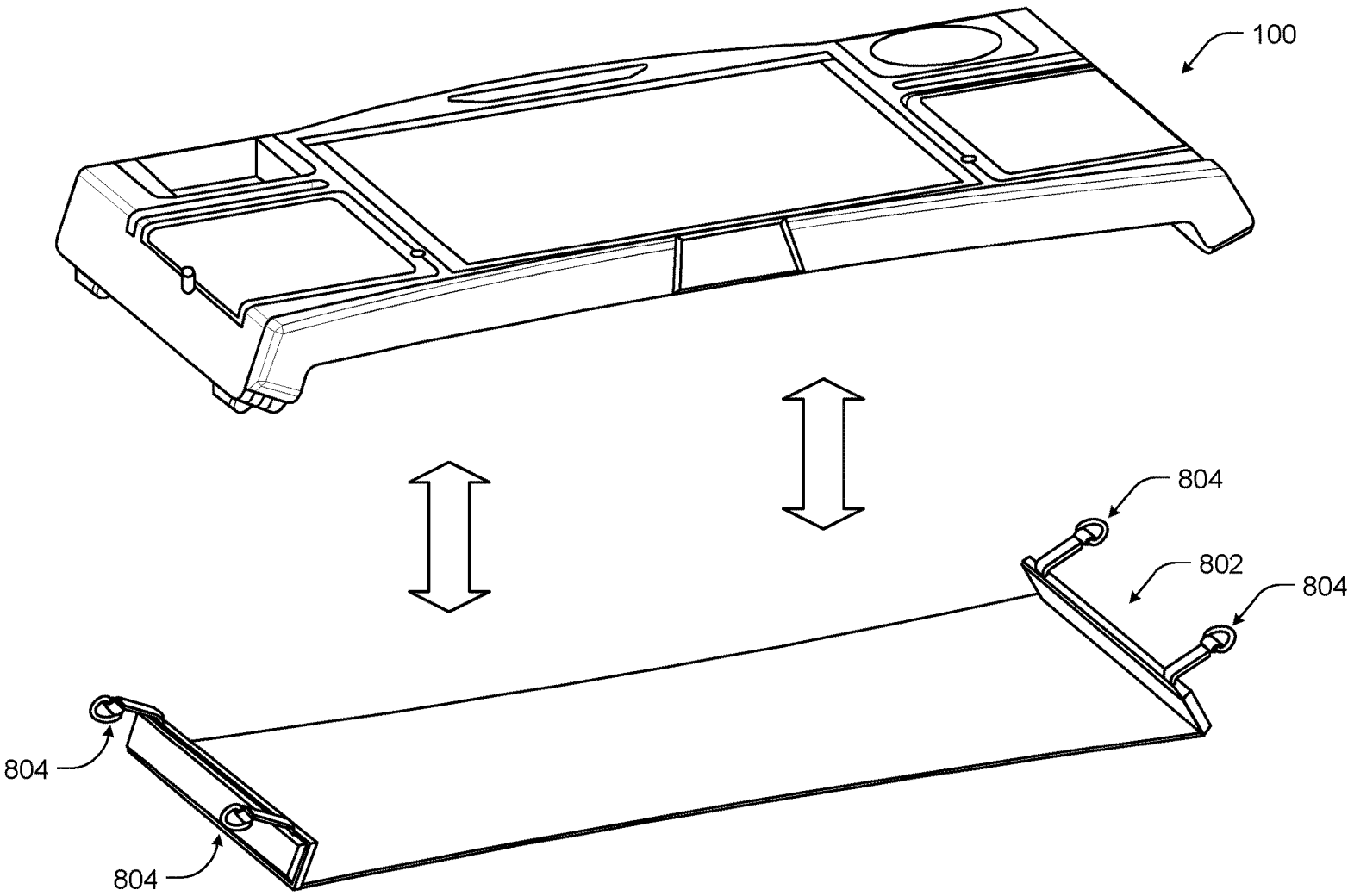
FIG. 9 illustrates another example perspective view of the lap desk in the closed position with netting removed according to some implementations.

FIG. 9 illustrates another example perspective view of the lap desk 100 in the closed position with netting 802 removed according to some implementations. In the previous example, the netting 802 included locking clips and slots on the underside or bottom surface of the desk 100. In this example, the netting 802 includes a D-ring type coupling 804 that attaches or mates with corresponding clips on the legs of the desk 100.

Figure 10:
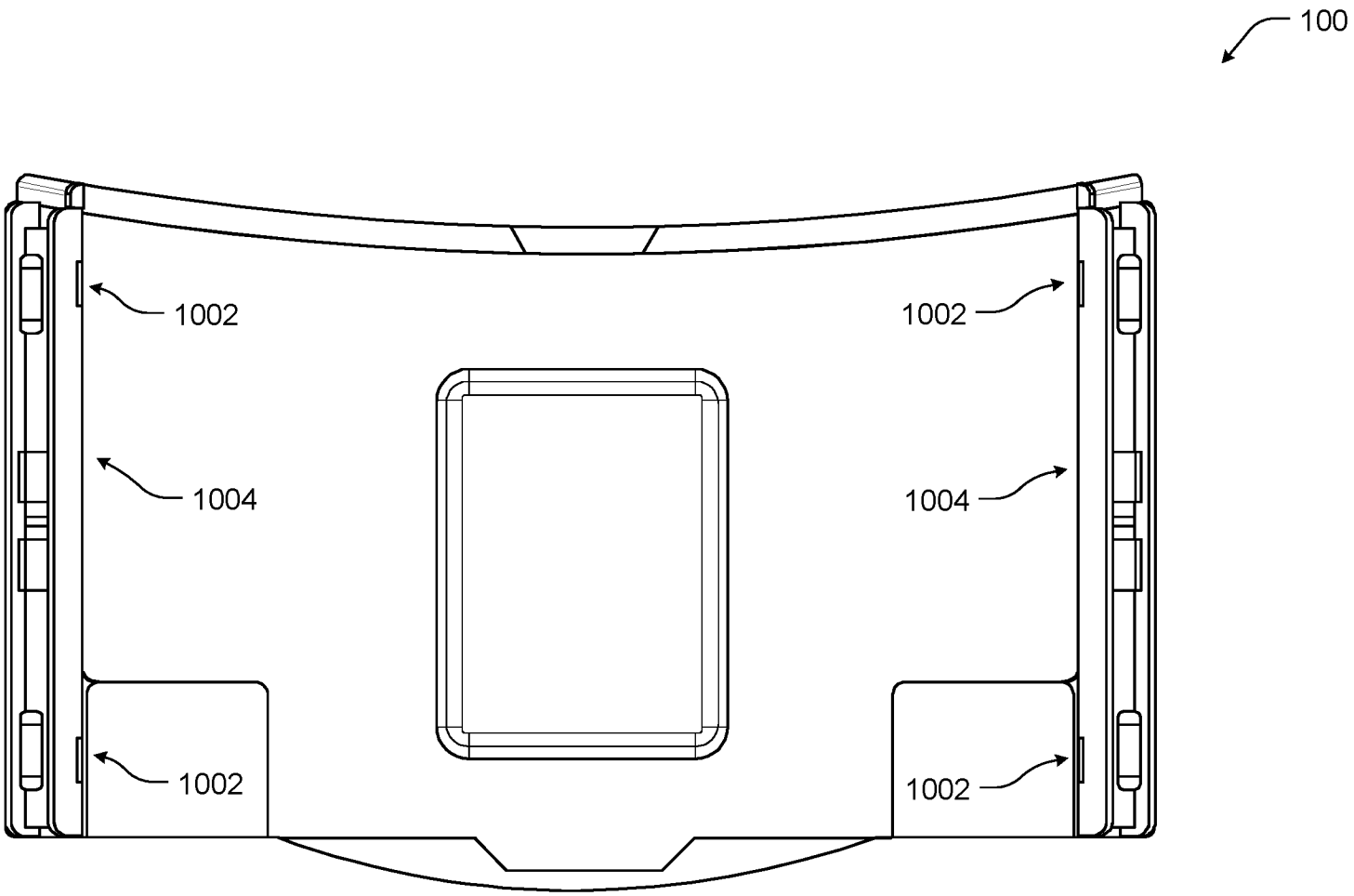
FIG. 10 illustrates an example bottom view of the lap desk with netting removed according to some implementations.

FIG. 10 illustrates an example bottom view of the lap desk 100 with netting 1002 removed according to some implementations. In the illustrated example, the mated clips, generally indicated by 1002, maybe positioned along two opposing angled surfaces 1004 such that the clips 804 of the netting 802 may be inserted and locked into place along the bottom of the desk 100. In another example, the surfaces 1004 and/or the mated clips 802 may be magnetized such that the netting clips 804 may magnetically couple to the desk 100 for ease of attachment and removal.

Figure 11:
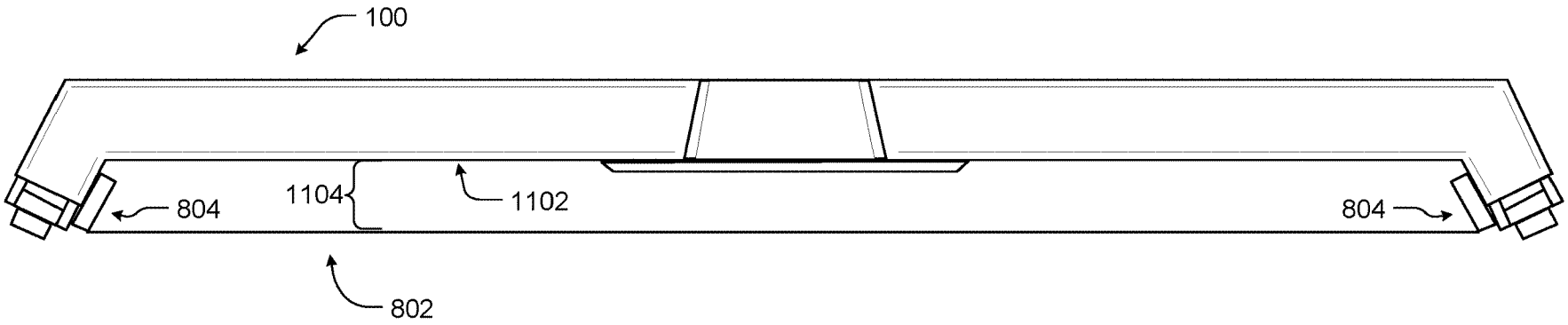
FIG. 11 illustrates an example front view of the lap desk with netting attached according to some implementations.

FIG. 11 illustrates an example front view of the lap desk 100 with netting 702 attached according to some implementations. In the current example, the netting 702 is coupled or attached below the bottom surface 1002 of the desk 100 via the surfaces 804. In some cases, such as the illustrated example, the netting 702 may be spaced apart from the bottom surface 1102 of the desk 100 by a gap, generally indicated by 1104. In some cases, the gap 1104 may be between approximately 0.65 inches and 1.27 inches from the bottom surface 902 of the desk 100. In another example, the gap 904 may be between approximately 0.5 inches and 1.5 inches from the bottom surface 902 of the desk 100. In some cases, the gap 1104 may allow the netting 802 to deform upwards towards the bottom surface 1102 of the desk 100 when in contact with the lap or legs of the user.

Figure 12:
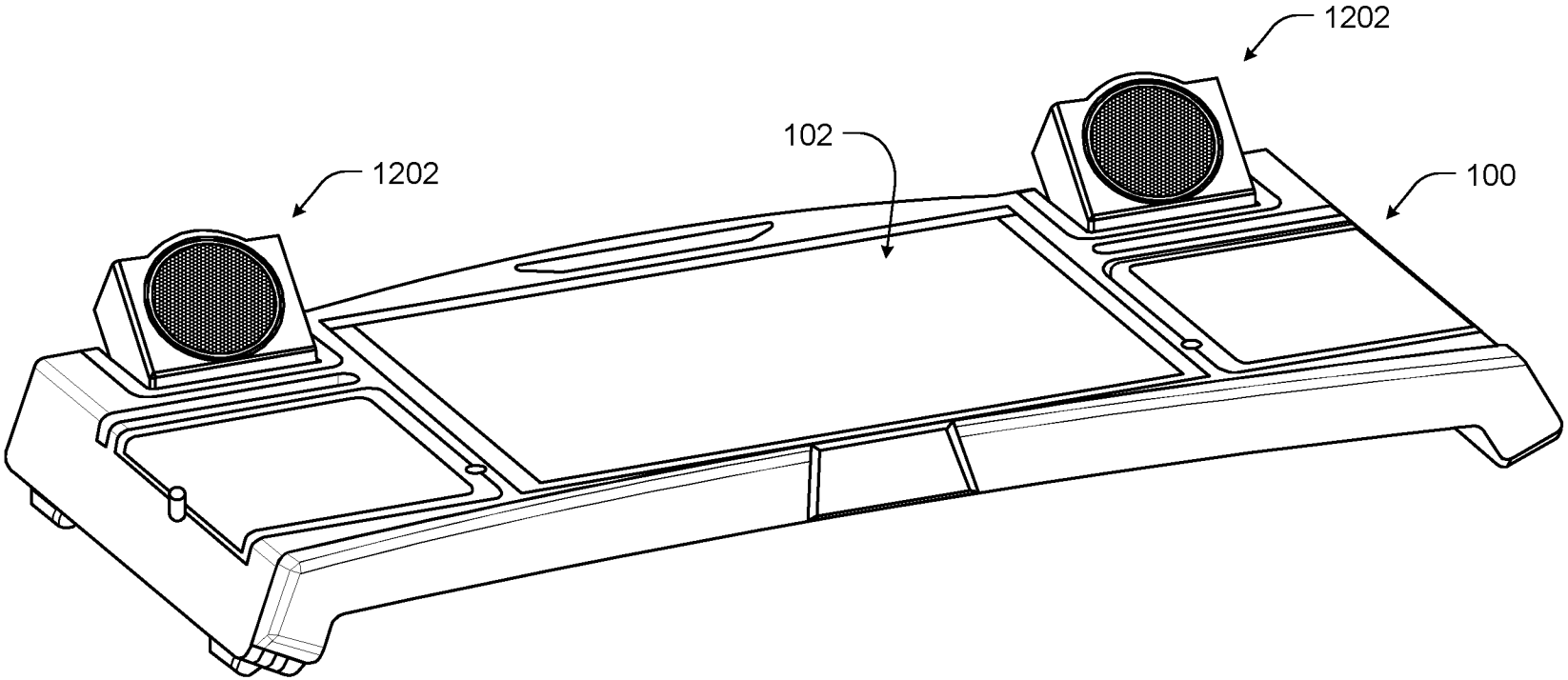
FIG. 12 illustrates is an example perspective view of the lap desk according to some implementations.

FIG. 12 illustrates is an example perspective view of the lap desk 100 according to some implementations. In the illustrated example, the tray 112 and a cup holder 114 have been removed or decoupled from the desk 100. Instead, two speakers 1202, such as a right and left speaker, have been coupled to the desk 100 in place of the tray 112 and a cup holder 114. In some cases, the speakers 1202 may be in wireless communication with a computing device placed upon the desk surface 102. In other cases, as discussed above, the desk surface 102 may include a docking station for the computing device and the speakers 1002 may electrically as well as mechanically couple to the desk 100, such that the electronic device coupled to the docking station may be in wired communication with the speakers 1202 via the desk 100. In this manner, the communication between the speaker 1202 (and other components, such as a memory device) and the electronic device may be more secure than a typical wireless arrangement.

Figure 13:
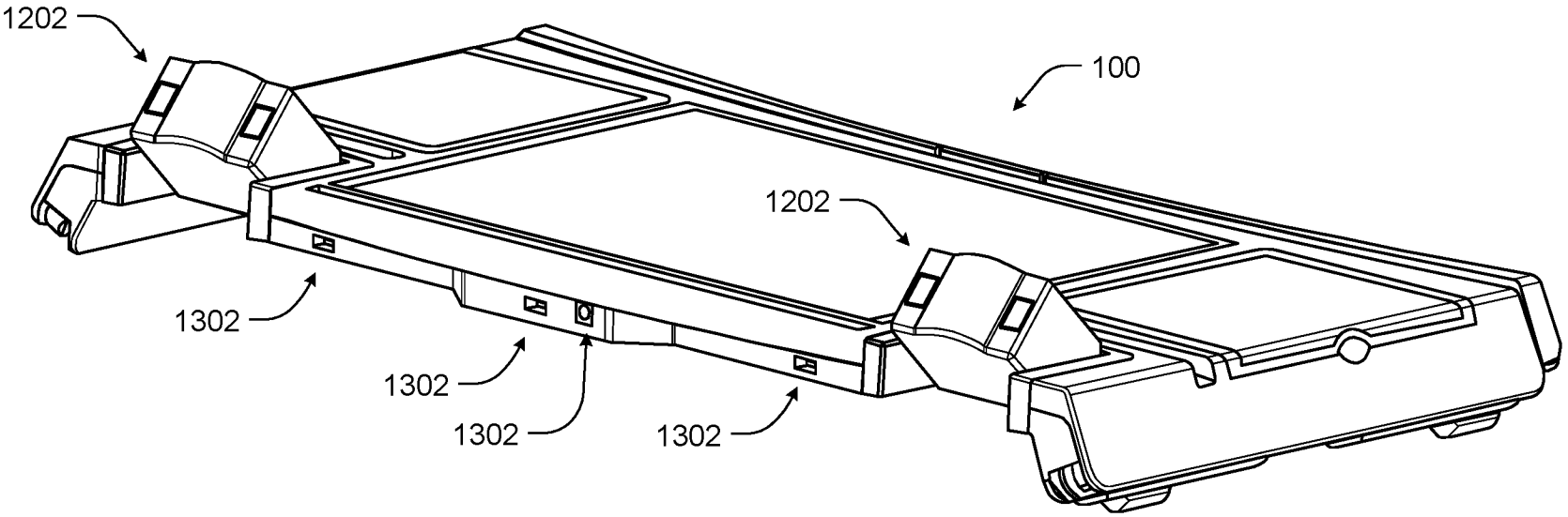
FIG. 13 illustrates another example perspective view of the lap desk according to some implementations.

FIG. 13 illustrates another example perspective view of the lap desk 100 according to some implementations. In this example, the lap desk 100 may include various electrical ports, generally indicated by 1302, that may be used to supply power, data, or other types of electrical couplings to and/or from the desk 100 (such as to recharge a on board power supply). In some examples, the pots 1302 may be coupled to a computing device, such that the computing device may communicate with various comments of the desk 100, such as the coupled speakers 1202.

Figure 14:
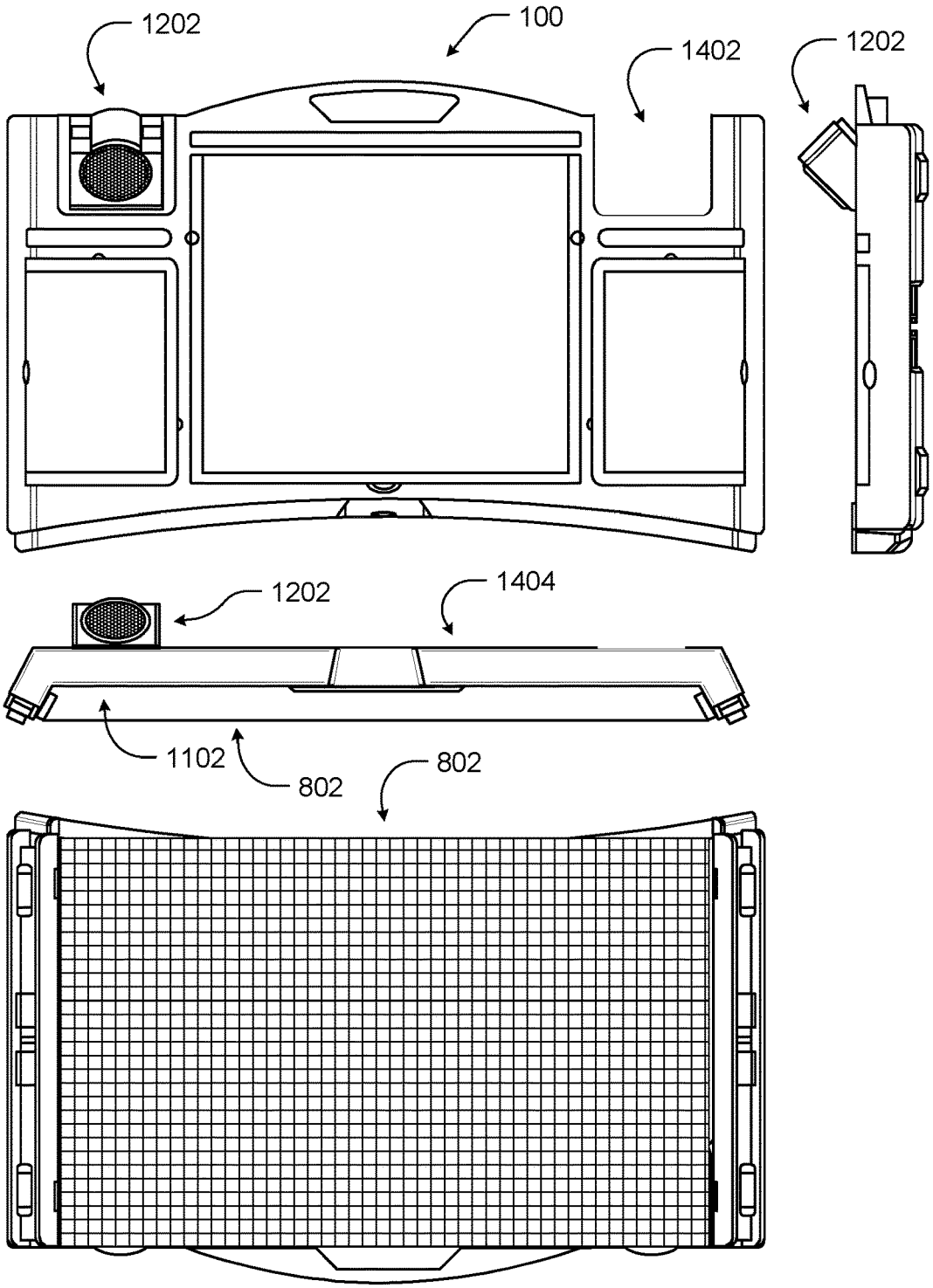
FIG. 14 illustrates an example top, bottom, left, and right view of the lap desk according to some implementations.

FIG. 14 illustrates an example top, bottom, left, and right view of the lap desk 100 according to some implementations. In the current example, the netting 802 is coupled below the bottom surface 1102 of the lap desk 100 and one of the speakers 1202 have been installed. Again it should be understood, that a speaker 1202, tray 112 or cup holder 114 may be installed into the desk 100 via the slots, generally indicated by 1402, as well as other components such as back-up battery or power supplies, speakers, lights, input devices, display components, touch enabled components, other types of user interfaces, communication interfaces, (USB) interfaces, DVD or CD readers, pen/pencil holders, pencil sharpeners, desk extenders, among others.

In the current example, the speaker 1202 is tilted up but it should be understood that in some cases, the speaker 1202 may be tilted down to be flush with the top surface 1404 of the desk 100 for stowing during transport.

Figure 15:
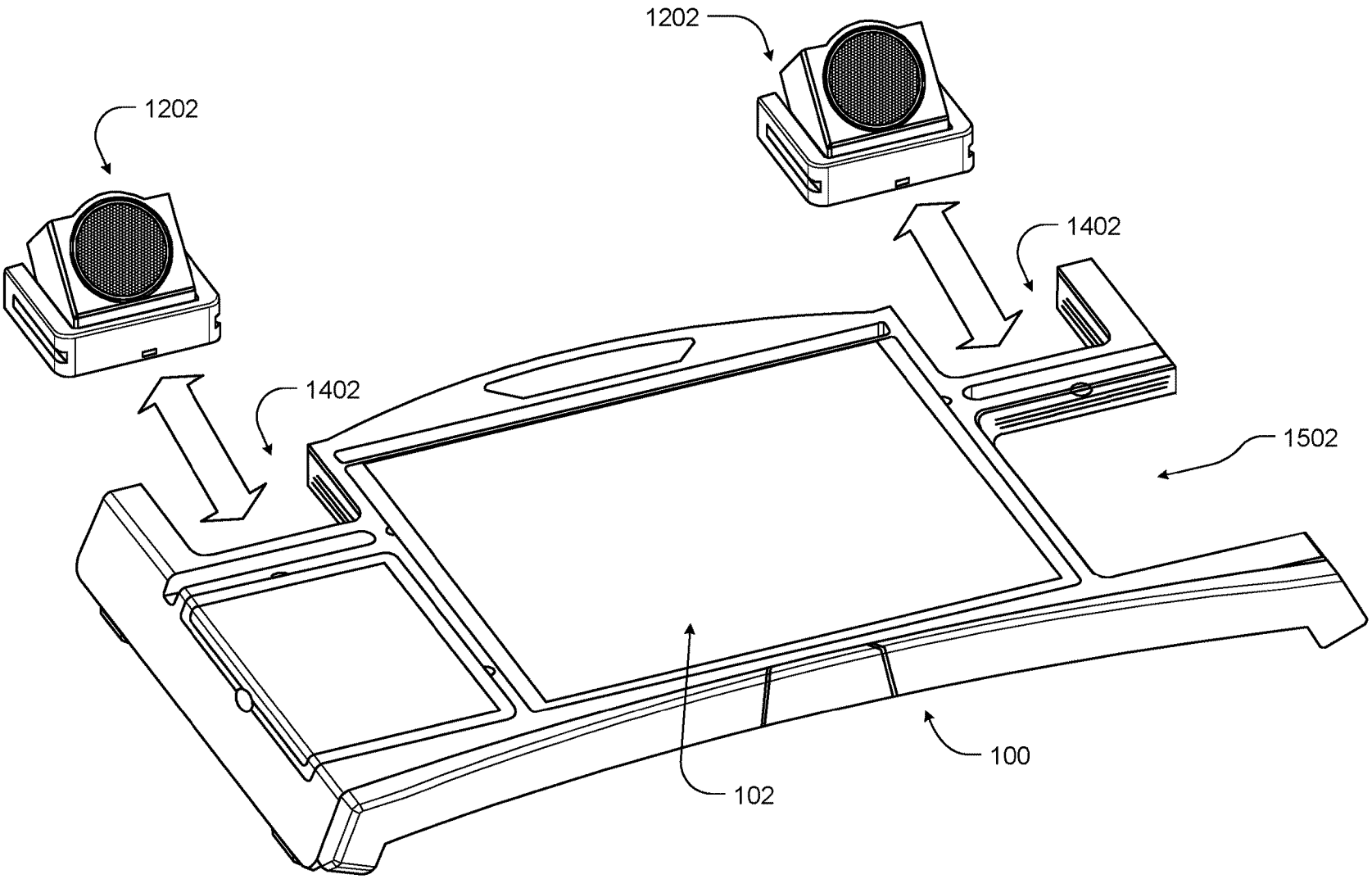
FIG. 15 illustrates an example perspective view of the lap desk with speakers decoupled from the right and left back sockets according to some implementations.

FIG. 15 illustrates an example perspective view of the lap desk 100 with speakers 1202 decoupled from the right and left back sockets, generally indicated by 1402, according to some implementations. As discussed above, the desk 100 may include various locations and components that are interchangeable, such that the desk 100 may be customized for each user, per each particular use, and/or for each particular environment.

Thus, in the illustrated example, the desk 100 includes the right and left back slots 1402 as well as a right and left side slot, generally indicated by 1502. The desk 100 may also include a removable or interchangeable desk surface 102. In this manner, the user may select the functionality, cosmetic appearance, and materials for each component that maybe coupled to the desk 100. In some cases, the desk may include two or more interchangeable slots, three or more interchangeable slots, five interchangeable slots, or more than five interchangeable slots.

Figure 16:
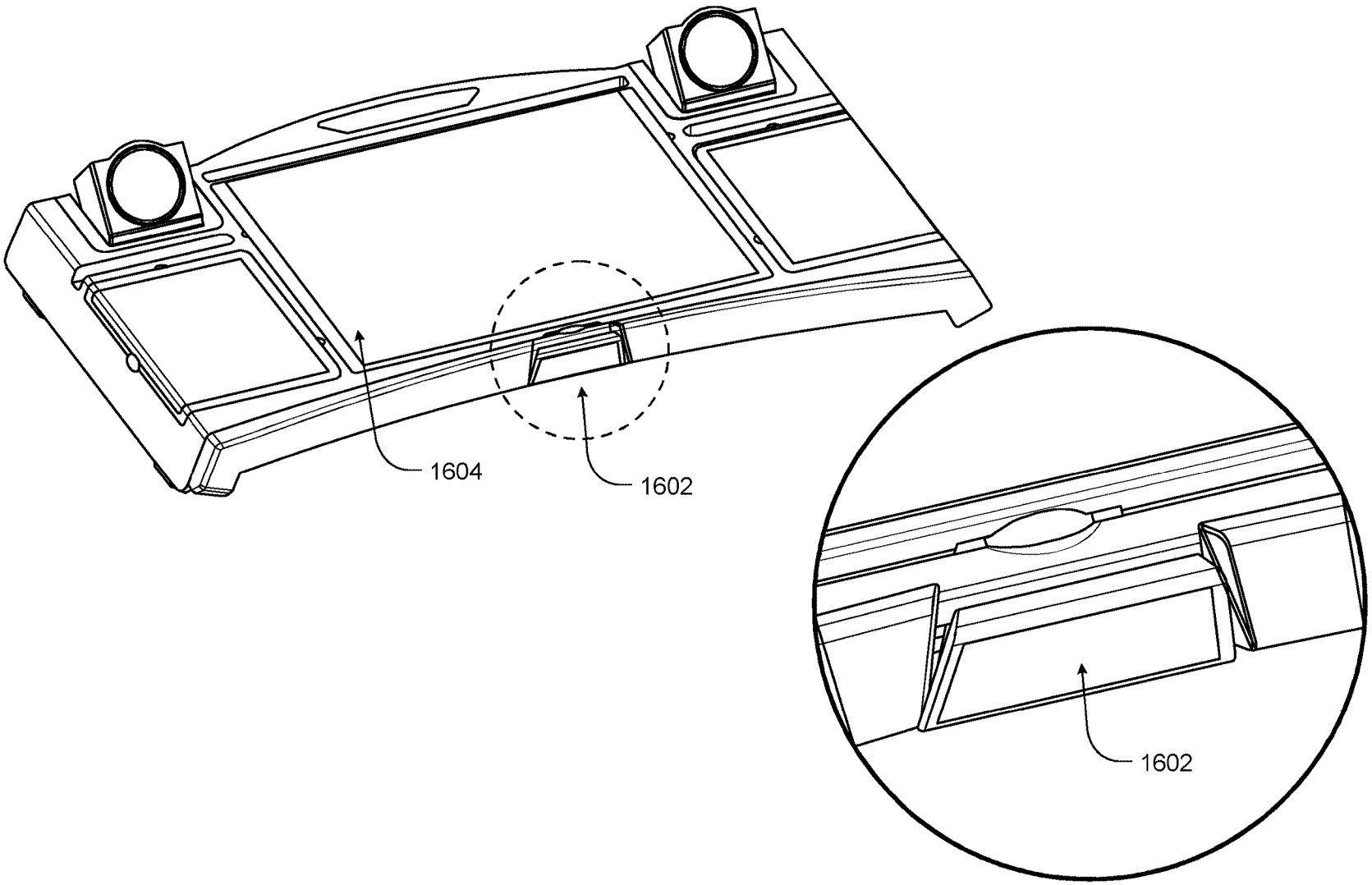
FIG. 16 illustrates an example perspective view of the lap desk having a release for raising the desk surface according to some implementations.

FIG. 16 illustrates an example perspective view of the lap desk 100 having a release 1602 for raising the desk surface 1604 according to some implementations. In some cases, the lap desk 100 may be configured to include interior storage space and/or cable routing space. In these cases, the desk surface 1604 may be releasable via the release 1602 such that the desk surface 1604 may be raised and the interior storage space and/or cable routing space may be accessed by a user, as will be described in more detail below with respect to FIG. 17. As illustrated, the user may unclip or unlock the release 1602 allowing for the desk surface 1604 to be raised or otherwise removed.

Figure 17:
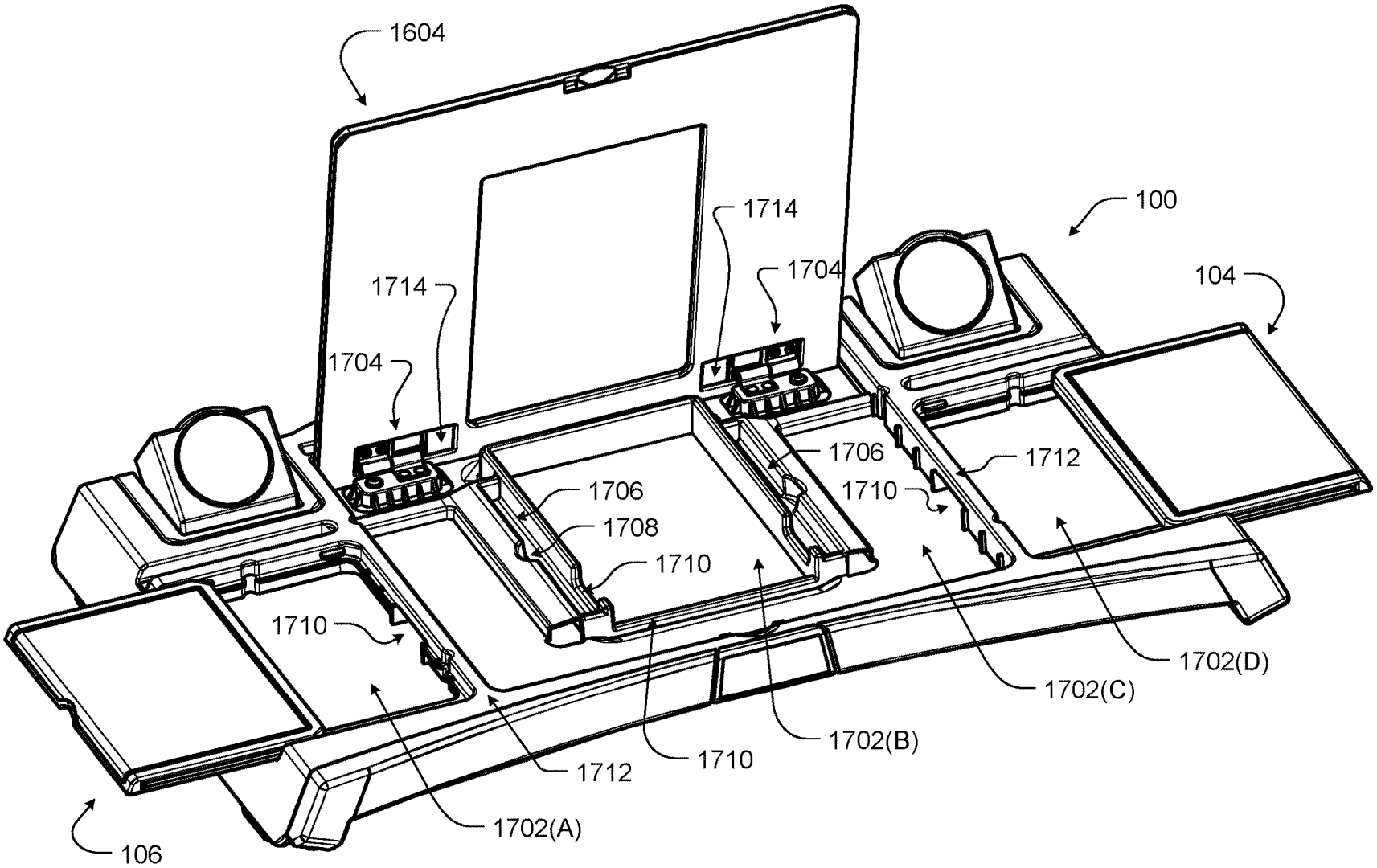
FIG. 17 illustrates an example perspective view of storage and cable routing compartments of the lap desk according to some implementations.

FIG. 17 illustrates an example perspective view of storage and cable routing compartments 1702 of the lap desk 100 according to some implementations. For example, as discussed above, the desk surface 1604 may be released and raised by the user to access the storage and cable routing compartments 1702(B) and 1702(C). In the current example, the desk surface 1604 is raised by a pair of cancelled hinges 1704. The right pad surface 104 and the left pad surface 106 are configured to slide to allow access to the storage and cable routing compartments 1702(A) and 1702(B). It should be understood that in other implementations the desk surface 1604, the right pad surface 104 and/or the left pad surface 106 may be completely removable and/or moveable by various known components and techniques.

In some instances, the storage and cable routing compartments 1702 may be configured to provide storage for particular components. For example, the storage and cable routing compartments 1702(B) may be configured to house one or more power sources or batteries for recharging electrical devices placed on the desk surface 1604. Additionally, in the illustrated example, slots, generally indicated by 1706, may be included to keep items such as stylus and pens from rolling or otherwise moving while the desk 100 is being transported. In the current example, the stylus or pen slots 1706 may also include finger access ports 1708 to allow the user to more easily remove the stylus, pen, USB drive, memory stick, or pencil from the slots 1706.

The desk 100 may also include cable routing passages 1710 along walls 1712 of the desk 100 that separate the various compartments 1702 and slots 1706. The passages 1710 the user may couple various components together out of sight and without mess. For instance, the user may place a memory drive in the compartment 1702(A), a backup battery in compartment 1702(B), and a tablet in compartment 1702(D). The user may then electrically couple the memory drive, the backup battery, and the tablet together using the passages 1710.

In the illustrated example, the desk 100 also includes exit passages 1714 for routing the cable out of the interior compartments 1702 to couple to a power source (such as a wall plug) or to another device (e.g., a personal computer) placed on the surface of the desk 100. In this manner, the user may electrically couple the memory device, backup battery, tablet, and personal computer together without removing the memory device, backup battery, or tablet from the interior compartments 1702. Thus, when the user moves locations, the user may unplug the personal computer, move the desk 100, and then recouple the personal computer without the hassle of setting up the other devices (e.g., the memory device, backup battery, and tablet).

In some cases, the lap desk 100 may include a removable insert (not shown) that may be configured to be located within the interior compartments 1702. The insert may be sized and/or otherwise configured to receive a power source and secure a power source that may be coupled to the various devices and components of the desk 100. In some instances, the insert may be made of foam or polyurethane. In other instances, the insert may include cooling features or heat sinks to reduce the operating temperature of the power source.

Figure 18:
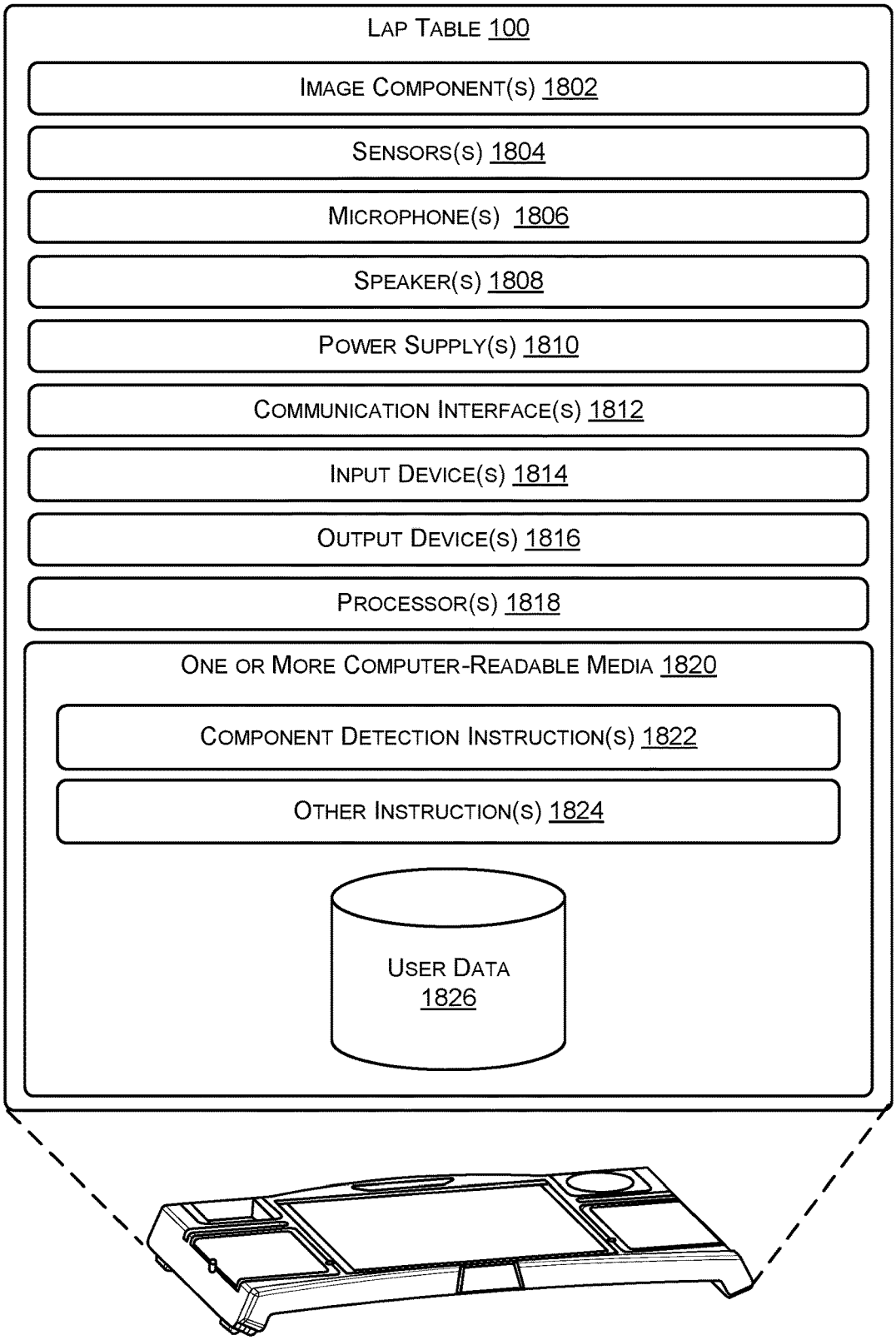
FIG. 18 illustrates example components of the lap desk according to some implementations.

FIG. 18 illustrates example components of the lap desk 100 according to some implementations. As described above, the lap desk 100 may include electrical components and/or slots/interfaces for releasably coupling to various electrical components. The lap desk 100 may also include various permeant components, such as image components 1802, sensors 1804, microphones 1806, speakers 1808, power supplies 1810, communication interfaces 1812, input devices 1814, output devices 1816, processors 1818, and/or computer-readable media 1820.

The image components 1802 for capturing visual data, such as images or frames, from a physical environment (e.g., the venue, the container, the merchandise, etc.). For example, the image components 1802 may be positioned to capture multiple images of the physical environment or an area proximate to the user and the lap desk 100.

Thee sensors 1804 to collect access data as well as other data, such as impact data, motion data, weight data, pressure data, etc. associated with the desk 100. For instance, the sensors 1804 may include one or more accelerometers, one or more gyroscopes, one or more magnetometers, one or more presence sensors, and/or one or more pressure sensors, as well as other sensors.

The microphones 1806 for capturing audio data from the physical environment. The microphones 1806 may be one or more microphones or an array of microphones associated or positioned around the desk 100 to capture sound in the physical environment as well as directionally of the sound.

The speakers 1808 may be configured to output audio data as sound. For examples, the speakers 1808 may include one or more speakers such as an array of speakers. In some cases, the speakers 1808 may be arranges to reproduce directionality of sound, such as when a user is consuming video content.

The power supply 1810, such as a battery, may be configured to provide power to the desk 100 as well as other nearby or electrically coupled devices. The power supply 1810 may also be configured to recharge from an external power source.

The communication interfaces 1812 configured to facilitate communication between one or more networks, one or more cloud-based system and/or one or more local devices (such as an associated and/or paired electronic device of the user). The communication interfaces 1812 may also facilitate communication between one or more wireless access points, a master device, and/or one or more other computing devices as part of an ad-hoc or home network system. The communication interfaces 1812 may support both wired and wireless connection to various networks, such as cellular networks, radio, WiFi networks, short-range or near-field networks (e.g., Bluetooth®), infrared signals, local area networks, wide area networks, the Internet®, and so forth.

The input devices 1814 may be a mechanical input device (e.g., keyboard, joystick, etc.) or touch enabled component or sensor (e.g., capacitive touch sensor or resistive touch sensor, etc.). The input devices 1814 may allow the user to provide inputs to the desk 100 or a device coupled to or in wireless communication with the desk 100.

The output devices 1816 may be one or more display for providing visual feedback to the user. The output device 1816 may also include one or more tactile outputs, such as haptic feedback units for providing a physical feedback to the user, such as vibrating to provide a low power warning signal. In some cases, the input devices 1814 and output devices 1816 may be combined into a single device, The processors 1818, such as at least one or more access components, control logic circuits, central processing units, or processors, as well as one or more computer-readable media 1820 to perform the function. Additionally, each of the processors 1818 may itself comprise one or more processors or processing cores.

Depending on the configuration, the computer-readable media 1820 may be an example of tangible non-transitory computer storage media and may include volatile and non-volatile memory and/or removable and non-removable media implemented in any type of technology for storage of information such as computer-readable instructions or modules, data structures, program modules or other data. Such computer-readable media may include, but is not limited to, RAM, ROM, EEPROM, flash memory or other computer-readable media technology, CD-ROM, digital versatile disks (DVD) or other optical storage, magnetic cassettes, magnetic tape, solid state storage, magnetic disk storage, RAID storage systems, storage arrays, network attached storage, storage area networks, cloud storage, or any other medium that can be used to store information and which can be accessed by the processors 1818.

Several modules such as instruction, data stores, and so forth may be stored within the computer-readable media 1820 and configured to execute on the processors 1818. For example, as illustrated, the computer-readable media 1820 store component detection instructions 1822 as well as other instructions 1824. The computer-readable media 1820 may also store data, such as user data 1822 (e.g., user settings and user preferences).

The component detection instructions 1822 may be configured to sense when a new component has been coupled to the desk 100 and to identify a type associated with the component. For instance, the component detection instructions 1822 may identify when a speaker is coupled to one of the back slots or when a touch screen or input device is coupled to a side slot. The component detection instructions 1822 may also cause stored settings to be applied to the detected component. For example, a sensitivity setting may be applied to the touch screen when detected.

Figure 19:
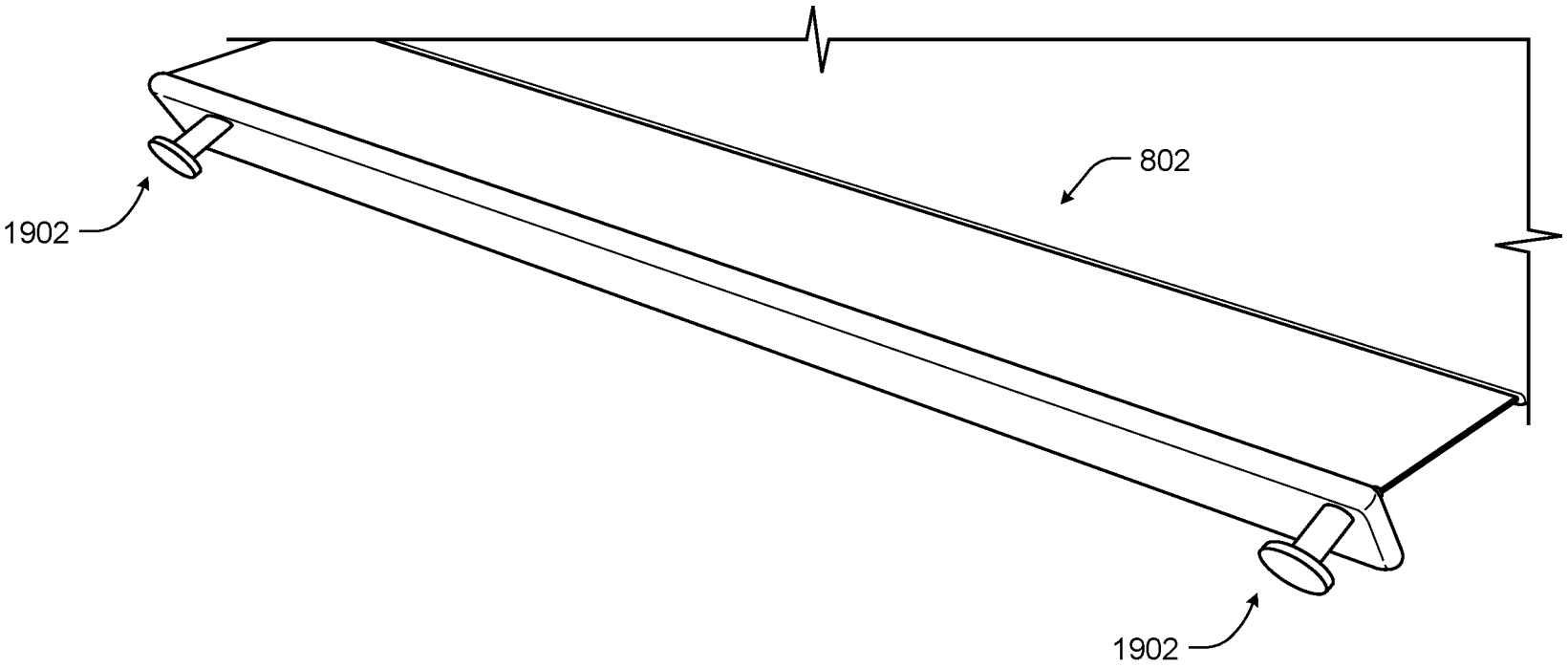
FIG. 19 illustrates an example perspective view of netting for use with the lap desk according to some implementations.

FIG. 19 illustrates an example perspective view of netting 802 for use with the lap desk (not shown) according to some implementations. In the illustrated example, the netting 802 includes multiple connectors 1902 that may be used to releasably couple the netting 802 to the desk. In the current example, the connectors 1902 are around but it should be understood that various types of connectors, including clips, hook and loop, other shaped key connectors (e.g., square, triangular, etc.), fasteners, snaps, etc. may be used as well as the D-ring couplings shown below with respect to FIG. 20.

Figure 20:
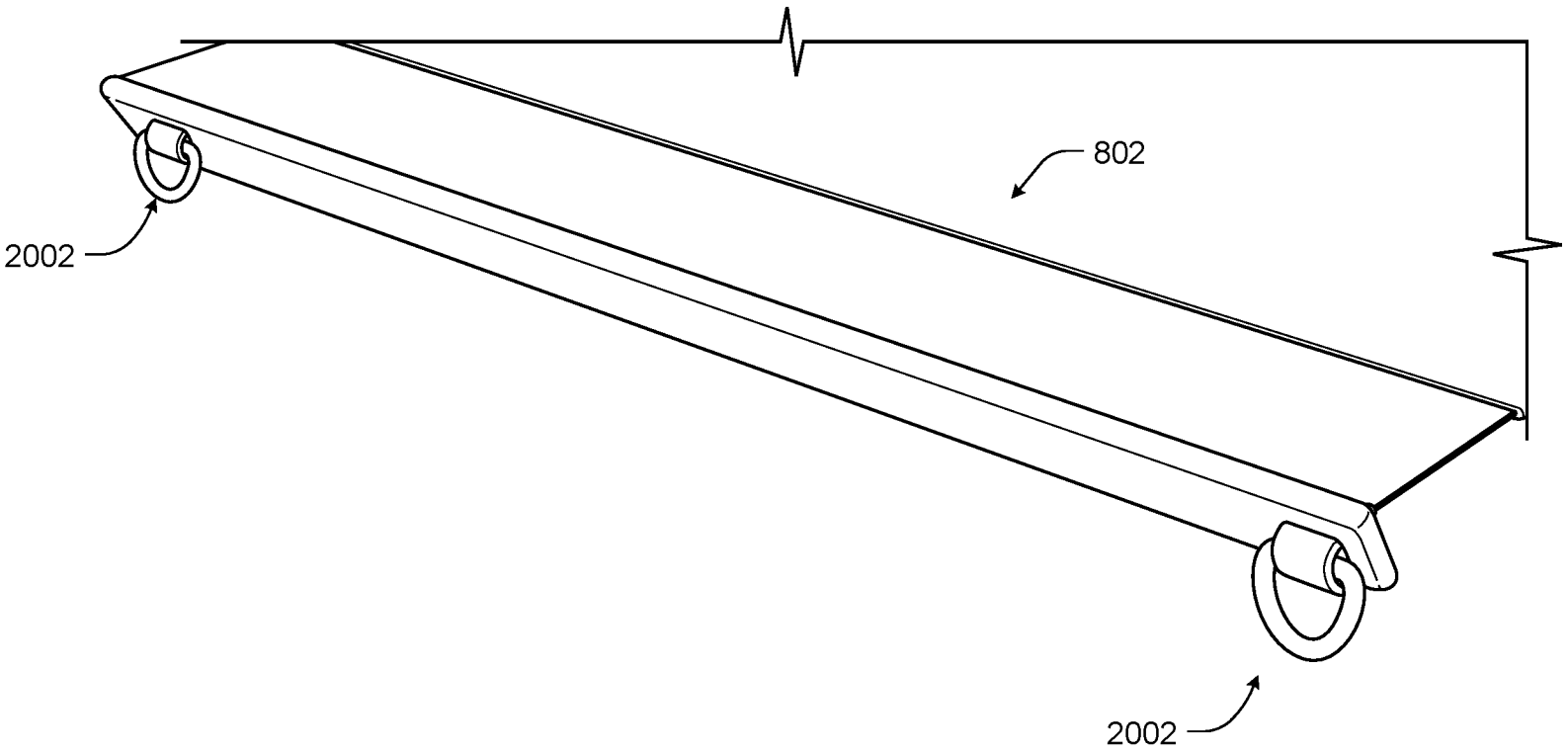
FIG. 20 illustrates another example perspective view of netting for use with the lap desk according to some implementations.

FIG. 20 illustrates another example perspective view of netting 802 for use with the lap desk (not shown) according to some implementations. In the illustrated example, the netting 802 includes multiple connectors 2002 that may be used to releasably couple the netting 802 to the desk. In the current example, the connectors 2002 are shown as D-ring couplings that mate or couple to the legs of the desk.

Although the subject matter has been described in language specific to structural features, it is to be understood that the subject matter defined in the appended claims is not necessarily limited to the specific features described. Rather, the specific features are disclosed as illustrative forms of implementing the claims.

What is claimed is:

1. An apparatus comprising:

a desk having a top surface and a bottom surface, the top surface of the desk including a desk surface, a first side pad surface, and a second side pad surface, the first side pad surface and the second side pad surface being removable;

a plurality of retractable legs coupled to the bottom surface of the desk, each of the retractable legs having a closed position, a partially extended position, and a fully extended position and wherein each of the plurality of retractable legs locks in place in each of the closed position, the partially extended position, and the fully extended position;

at least one cable routing passages positioned between the top surface and the bottom surface of the desk providing for cable routing from a first location to a second location and from the first location to a third location; and the second location and the third location being adjacent to respective ones of the first side pad surface and the second side pad surface; and netting configured to releasably couple under the bottom surface of the desk, the netting configured to contact legs of a user during use of the apparatus with one or more of the plurality of retractable legs in the closed position.

2. The apparatus as recited in claim 1, wherein the netting is retractable.

3. The apparatus as recited in claim 1, wherein each of the plurality of retractable legs unfold from the closed position to the partially extended position and extend from the partially extended position to the fully extended position.

4. The apparatus as recited in claim 1, further comprising on onboard power supply; and the first location being adjacent to the onboard power supply.

5. The apparatus as recited in claim 1, wherein the desk includes a first accessory slot and a second accessory slot, the first accessory slot positioned to a first side of the desk surface and adjacent to the first side pad surface and the second accessory slot is positioned to a second side of the desk surface and adjacent to the second side pad surface, the first side opposite the second side.

6. The apparatus as recited in claim 5, wherein the first accessory slot is configured to mechanically and electrically couple to a first speaker and the second accessory slot is configured to mechanically and electrically couple to a second speaker.

7. The apparatus as recited in claim 1, wherein the top surface of the desk has an open position and a closed position, the open position to expose a plurality of compartments to a user.

8. An apparatus comprising:

a desk portion having a top surface and a bottom surface, the top surface of the desk portion including a desk surface, a first removable side pad surface, a second removable side pad surface, a first accessory slot, and a second accessory slot;

a plurality of retractable legs coupled to the bottom surface of the desk portion, each of the retractable legs having a closed position, a partially extended position, and a fully extended position and wherein each of the plurality of retractable legs locks in place in each of the close position, the partially extended position, and the fully extended position;

a power supply configured to provide power to electrical components coupled to the desk portion via the first removable side pad surface, the second removable side pad surface, the first accessory slot, or the second accessory slot;

at least one cable routing passages positioned between the top surface and the bottom surface of the desk portion providing for cable routing from a first location to a second location and from the first location to a third location;

netting configured to releasably couple under the bottom surface of the desk portion, the netting configured to contact legs of a user during use of the apparatus with one or more of the plurality of retractable legs in the closed position;

the first location being adjacent to the power supply; and the second location and the third location being adjacent to respective ones of: the first removable side pad surface, the second removable side pad surface, the first accessory slot, or the second accessory slot.

9. The apparatus as recited in claim 8, wherein the first accessory slot and the first removable side pad surface are positioned to a first side of the desk surface and the second accessory slot and the second removable side pad surface are positioned to a second side of the desk surface, the first side opposite the second side.

10. The apparatus as recited in claim 8, wherein the top surface of the desk portion has an open position and a closed position, the open position to expose the at least one cable routing passages and the power supply.

11. An apparatus comprising:

a desk portion having a top surface and a bottom surface, the top surface of the desk portion including a desk surface, a first side pad slot, a second side pad slot, a first accessory slot, and a second accessory slot;

a power supply configured to provide power to electrical components coupled to the desk portion via the first side pad slot, the second side pad slot, the first accessory slot or the second accessory slot; and at least one cable routing passages between the top surface and the bottom surface of the desk portion providing for cable routing from a first location to a second location and from the first location to a third location;

the first location being adjacent to the power supply;

the second location and the third location being adjacent to respective ones of:

the first side pad slot, the second side pad slot, the first accessory slot, or the second accessory slot; and wherein the first side pad slot includes mechanical and electrical couplings configured to receive at least one of a mouse pad, and integrated mouse, a touch pad, a numerical key pad, a speaker, a display, or a storage compartment.

12. The apparatus as recited in claim 11, wherein the first accessory slot and the first side pad slot are positioned to a first side of the desk surface and the second accessory slot and the second side pad slot are positioned to a second side of the desk surface, the first side opposite the second side.

13. The apparatus as recited in claim 11, wherein the top surface of the desk portion has at least one storage compartment and an open position and a closed position, the open position to expose the at least one storage compartment, the at least one cable routing passages and the power supply.

14. The apparatus as recited in claim 13, wherein the desk portion includes a release mechanism to allow the top surface to transition between the closed position and the open position.

15. The apparatus as recited in claim 11, further comprising a plurality of retractable legs coupled to the bottom surface of the desk portion, each of the retractable legs having a closed position, a partially extended position, and a fully extended position and wherein each of the plurality of retractable legs locks in place in each of the close position, the partially extended position, and the fully extended position.

16. The apparatus as recited in claim 15, further comprising netting to contact legs of a user during use of the apparatus with one or more of the plurality of retractable legs in the closed position.

17. The apparatus as recited in claim 11, wherein the first accessory slot, or the second accessory slot includes mechanical and electrical couplings configured to receive at least one of a speaker, a display, a touch screen, a device holder, a cell phone holder, a cup holder, a paper holder, or a storage compartment.

18. The apparatus as recited in claim 11, wherein the desk portion includes an integrated handle.

* * * * *